US009770928B2

(12) United States Patent
Harayama et al.

(10) Patent No.: US 9,770,928 B2
(45) Date of Patent: Sep. 26, 2017

(54) PRINTING APPARATUS

(71) Applicant: MIMAKI ENGINEERING CO., LTD., Nagano (JP)

(72) Inventors: Ryuta Harayama, Nagano (JP); Shunsuke Akuta, Nagano (JP); Katsutoshi Yamabe, Nagano (JP); Tomonori Amari, Nagano (JP); Eiji Miyashita, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/153,723

(22) Filed: May 12, 2016

(65) Prior Publication Data

US 2016/0332464 A1 Nov. 17, 2016

(30) Foreign Application Priority Data

May 15, 2015 (JP) ..... 2015-100517

(51) Int. Cl.
*B41J 29/02* (2006.01)
*B41J 11/00* (2006.01)
*B41J 11/04* (2006.01)

(52) U.S. Cl.
CPC ..... *B41J 29/02* (2013.01); *B41J 11/002* (2013.01); *B41J 11/006* (2013.01); *B41J 11/0045* (2013.01); *B41J 11/04* (2013.01)

(58) Field of Classification Search
None
See application file for complete search history.

(56) References Cited

U.S. PATENT DOCUMENTS 8,808,794 B2 * 8/2014 Borsting ..... B29C 37/0032 427/133
9,004,571 B1 * 4/2015 Bernardo ..... B60J 7/141 296/100.03
9,177,684 B2 * 11/2015 Uchida ..... B41J 2/01
9,493,015 B2 * 11/2016 Monclus Velasco .. B41J 11/002
2001/0035065 A1 * 11/2001 Hashimoto ..... B25J 18/025 74/490.04
2006/0055757 A1 * 3/2006 Yamashita ..... B41J 29/377 347/102

(Continued)

FOREIGN PATENT DOCUMENTS

JP 2013-119215 6/2013

*Primary Examiner* — Stephen Meier
*Assistant Examiner* — John P Zimmermann
(74) *Attorney, Agent, or Firm* — Jianq Chyun IP Office

(57) ABSTRACT

A printing apparatus is provided and includes cover members for covering at least a portion of a conveyance path for conveying a medium. The cover members are configured such that at least a portion of a part covering a conveyance path is able to expand and contract. Therefore, if necessary, it is possible to expand or contract the area of the cover members covering the conveyance path. On the occasion of setting the medium or when a jam has occurred, it is possible to contract the cover members in the conveyance direction of the medium. Also, even if the cover members move once from the state where they cover the conveyance path, it is possible to easily return the cover members to their original positions, and it is possible to easily return the cover members to the state where they cover a portion of the conveyance path.

16 Claims, 17 Drawing Sheets

(56) References Cited

U.S. PATENT DOCUMENTS

| | | | | |
|---|---|---|---|---|
| 2009/0115829 | A1* | 5/2009 | Reid | B41J 29/13 347/108 |
| 2010/0103237 | A1* | 4/2010 | Hara | B41J 11/002 347/102 |
| 2013/0229027 | A1* | 9/2013 | Copp | B60J 7/198 296/100.08 |

* cited by examiner

PRINTING APPARATUS

CROSS REFERENCE TO RELATED APPLICATIONS

This application claims the priority benefit of Japanese Patent Application No. 2015-100517, filed on May 15, 2015. The entirety of the above-mentioned patent application is hereby incorporated by reference herein and made a part of this specification.

TECHNICAL FIELD

The present disclosure relates to a printing apparatus.

RELATED ART

Printing apparatuses using inkjet heads jet ink from the inkjet heads onto media such as recording paper, thereby performing printing. However, in a case where ink is slowly dried, wet ink may be mixed, resulting in a decrease in chroma or blurring of images. Especially, in printing apparatuses, such as line printers, which eject ink in units of lines extending in a main scan direction while conveying media, since the amount of ink ejection relative to the medium conveyance speed is large, it is difficult for ink to be dried. For this reason, conventional printing apparatuses which positively dry ink ejected on media are described. For example, an inkjet apparatus disclosed in JP-A-2013-119215 includes a platen capable of heating media, a cover which covers a medium conveyance path, and a fan which blows air into a gap between the cover and a recording medium, and dries ink ejected on a medium by heating of the platen and an air flow from the fan.

However, in a case where the medium conveyance path is covered by the cover, since the cover becomes an obstacle when a user sets a medium or a jam has occurred, it is difficult to smoothly perform work such as setting of media. Also, since the cover is attached at a position where the cover can appropriately cover the medium conveyance path, if the cover is detached once, it is cumbersome and complicated to attach the cover again or move the cover to an appropriate position. As described above, in a case of providing a cover member for covering a medium conveyance path, maintainability of a printing apparatus may decrease.

SUMMARY

The present disclosure is made in view of the above described circumstances, and the present disclosure provides a printing apparatus capable of improving maintainability in a case of providing a cover member for covering a medium conveyance path.

In order to solve the above described problems, a printing apparatus according to the present disclosure is a printing apparatus which includes: a cover member, covering at least a portion of a conveyance path for conveying a recording medium, wherein the cover member is configured such that at least a portion of a part covering the conveyance path is able to expand and contract.

In this disclosure, the cover member can be expanded and contracted, if necessary, an area of the cover member covering the conveyance path can be expanded and contracted. Therefore, on the occasion of setting the recording medium or when a jam has occurred, it is possible to contract the cover member in the conveyance direction of the recording medium. Therefore, it is possible to suppress the cover member from interrupting setting of the recording medium or resolving of a jam. Also, since the cover member is provided so as to be able to expand and contract in the conveyance direction of the recording medium, even if the cover member moves once from the state where it covers the conveyance path, it is possible to easily return the cover member to its original position, and it is possible to easily return the cover member to the state where it covers a portion of the conveyance path. As a result, it is possible to improve maintainability in the case of providing the cover member for covering the conveyance path of the recording medium.

Also, in the above described printing apparatus, the printing apparatus may be an inkjet printing apparatus, and the conveyance path which is covered by the cover member may be a portion to which the recording medium after inkjet printing is conveyed.

In this disclosure, since the conveyance path to which the recording medium after inkjet printing is conveyed is covered by the cover member, it is possible to suppress contamination during inkjet printing, and even in a case of drying ink, it is possible to improve maintainability. In other words, in order to prevent something from coming into contact with the recording medium in a state where ink is wet after printing when inkjet printing is performed, or to dispose a unit for drying ink on the recording medium, the cover member may be provided to cover the conveyance path to which the recording medium after inkjet printing is conveyed. As described above, in the case where the printing apparatus is an inkjet printing apparatus, even if the cover member is provided to cover the conveyance path to which the recording medium after inkjet printing is conveyed, the cover member can expand and contract, and it is possible to improve maintainability while making it possible to appropriately perform inkjet printing.

Also, in the above described printing apparatus, the cover member may be divided into at least a first segment and a second segment in a conveyance direction of the recording medium, and between the first segment and the second segment, a rotator may be provided to connect the first segment and the second segment such that the first segment and the second segment are relatively rotatable with respect to each other, and the first segment and the second segment may be relatively rotatable by the rotator, whereby at least one of the first segment and the second segment is able to retreat from a position for covering the conveyance path.

In this disclosure, since the first segment and the second segment are connected so as to be relatively rotatable by the rotator, it is possible to easily obtain a structure in which the cover member can expand and contract in the conveyance direction of the recording medium. As a result, it is possible to easily improve maintainability in the case of providing the cover member for covering the conveyance path of the recording medium.

Also, in the above described printing apparatus, the rotator may be provided such that the first segment and the second segment is able to be folded.

In this disclosure, since the first segment and the second segment are connected so as to be foldable by the rotator, if the cover member covering the conveyance path is contracted in the conveyance direction of the recording medium, it is possible to save space after retreat of the cover member from the conveyance path. As a result, it is possible to more surely suppress the cover member from interrupting maintenance, and it is possible to more surely improve maintainability in the case of providing the cover member.

Also, in the above described printing apparatus, the rotator may be provided such that a rotating shaft is disposed in a direction perpendicular to the conveyance direction of the recording medium, and on one side of the cover member relative to the rotator in the conveyance direction of the recording medium, the rotating shaft may be provided, and on the other side of the cover member, guide supporting parts may be provided, and the first segment and the second segment of the cover member may be supported to be able to expand and contract by the rotating shaft and a guide device; and the guide device includes the guide supporting parts and guide parts which are formed in slit shapes and into which the guide supporting parts are inserted, and the guide parts may guide the guide supporting parts during expansion or contraction of the cover member.

In this disclosure, since both sides of the cover member in the main scan direction are supported by the rotating shaft and the guide device, the cover member can stably expand and contract in the conveyance direction of the recording medium. As a result, it is possible to more surely improve maintainability in the case of providing the cover member.

Also, in the above described printing apparatus, the rotator may be a hinge, and the hinge may cause the cover member not to protrude toward a side of the conveyance path during expansion or contraction of the cover member.

In the present disclosure, since the rotator and the guide device prevent the cover member from protruding into the printing apparatus during folding or unfolding, it is possible to prevent the cover member from coming into contact with the conveyance path or the recording medium, thereby damaging the recording medium and the like. Also, since the motion of the cover member during folding and unfolding is guided by the guide device, it is possible to smoothly perform work during folding or unfolding. As a result, it is possible to more surely improve maintainability in the case of providing the cover member.

Also, in the above described printing apparatus, the cover member may be divided into at least a first segment and a second segment in the conveyance direction of the recording medium, and in the first segment, sliding grooves may be formed along a conveyance direction of the recording medium, and both end edges of the second segment may be configured to be inserted into the sliding grooves such that the second segment is slidable along the sliding grooves.

In this disclosure, since the sliding grooves are formed in the cover member, and the first segment and the second segment are slidable, it is possible to expand or contract the cover member with a simple configuration, and it is possible to easily improve maintainability in the case of providing the cover member.

The printing apparatus according to the present disclosure has an effect that it is possible to improve maintainability in a case of providing a cover member for covering a medium conveyance path.

DETAILED DESCRIPTION OF EMBODIMENTS

Hereinafter, an embodiment of a printing apparatus according to the present disclosure will be described in detail with reference to the accompanying drawings. However, the present disclosure is not limited by the embodiment. Also, in components of the following embodiment, ones with which persons skilled in the art can easily substitute the components, and ones which are substantially identical to the components are included.

Embodiment

Figure 1:
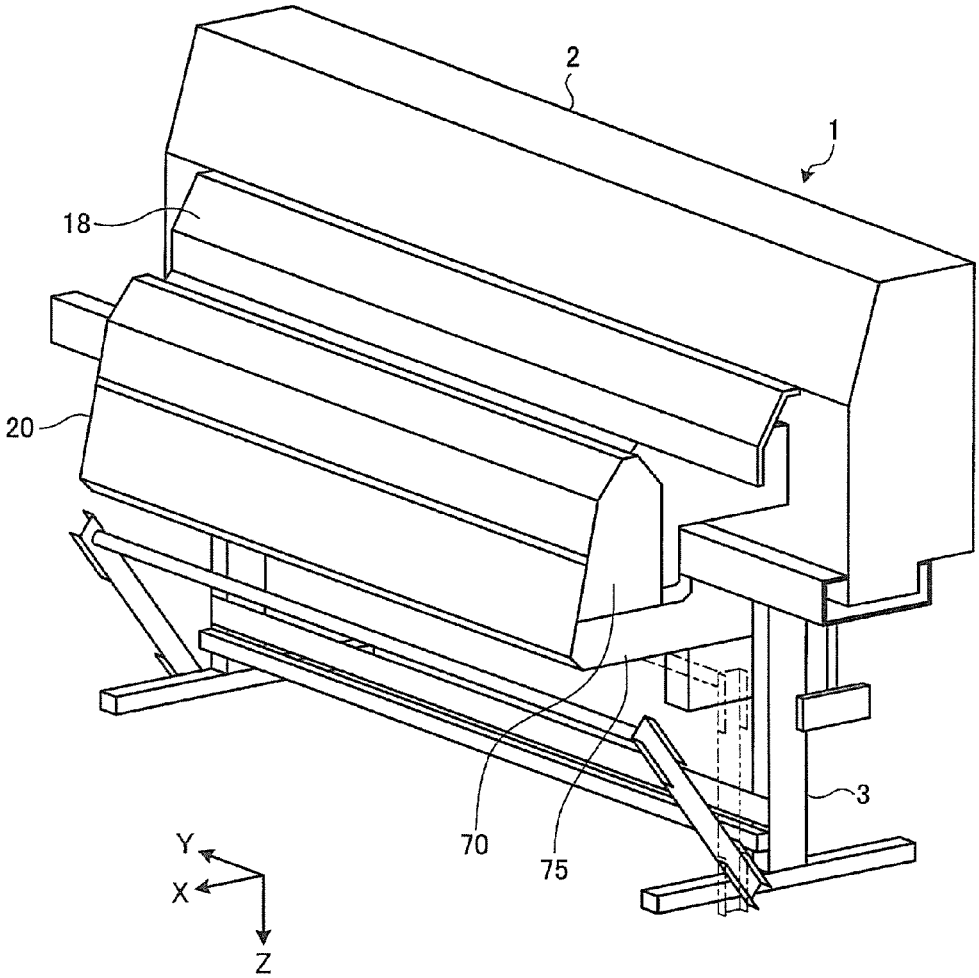
FIG. 1 is a perspective view of a printing apparatus according to an embodiment.
Figure 2:
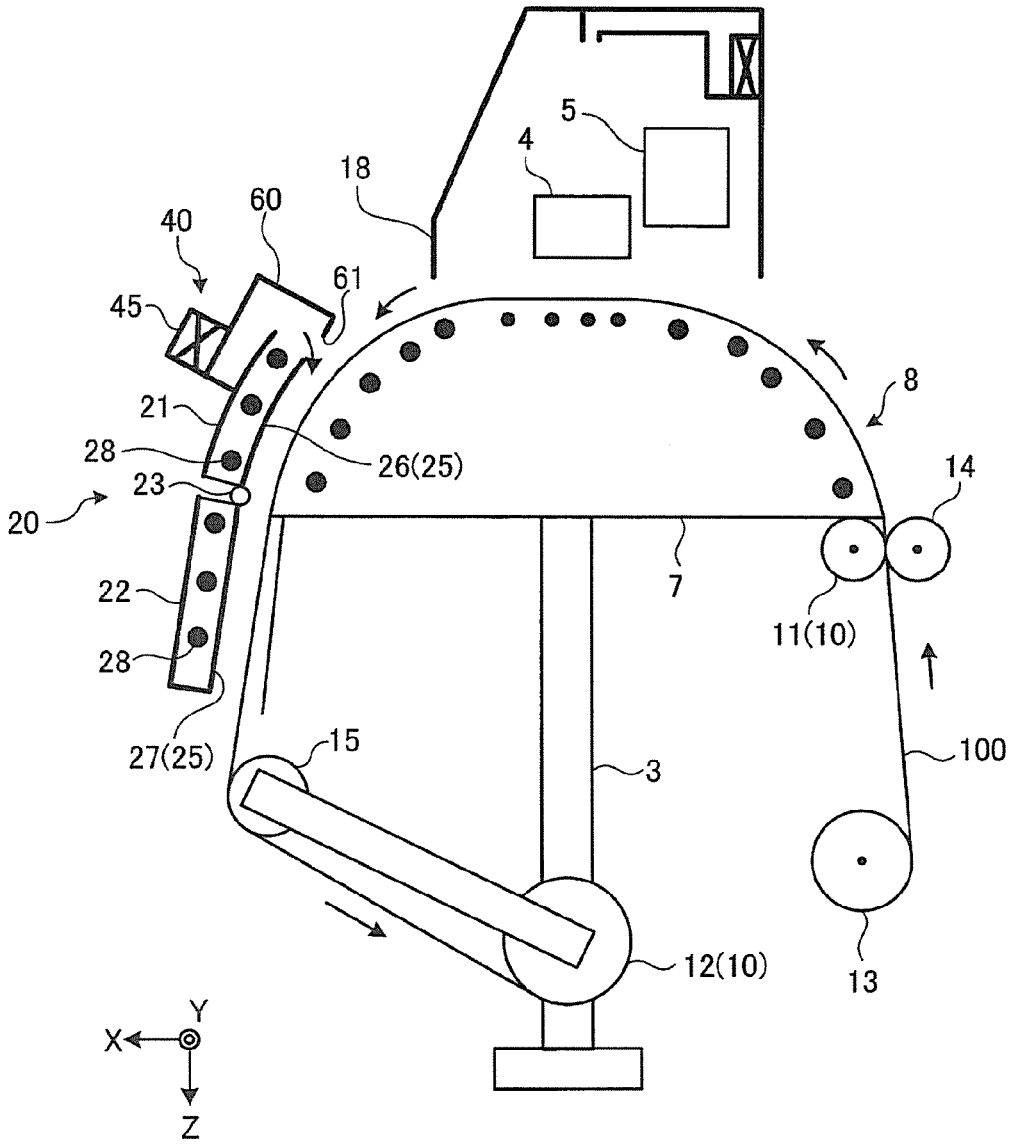
FIG. 2 is a schematic view illustrating the configuration of the printing apparatus shown in FIG. 1.

FIG. 1 is a perspective view of a printing apparatus of an embodiment. FIG. 2 is a schematic view illustrating the configuration of the printing apparatus shown in FIG. 1. A printing apparatus 1 according to the present embodiment is configured by assembling a dryer 20 with a printing apparatus main body 2, and the printing apparatus main body 2 includes a head 4, a platen 7, and a driver 10. The printing apparatus main body 2 is supported by legs 3, which are placed at desired positions on the ground, whereby the printing apparatus main body 2 is installed at an arbitrary installation position. The head 4 included in the printing apparatus main body 2 is configured to be able to eject ink onto a medium 100 which is a recording medium when performing printing on the medium 100. In other words, the printing apparatus 1 is provided as a so-called inkjet printing apparatus which performs printing by ejecting ink onto the medium 100. The head 4 of the printing apparatus main body 2 is configured to be able to eject ink while moving along a Y bar 5 extending in one direction, and the movement direction of the head 4 is a main scan direction (a Y direction in the drawings) when the printing apparatus 1 performs printing.

Also, the platen 7 is composed of a mounting table for mounting the medium 100 on the occasion of ejecting ink onto the medium 100. The head 4 is disposed above the platen 7, so as to be able to eject ink onto the medium 100 from the above of the medium 100 mounted on the platen 7.

Also, the driver 10 is configured so as to be able to relatively move the positions of the head 4 and the medium 100. Since the medium 100 is wound like a roll in advance by a medium feeding roller 13 for winding a medium 100 before printing, when the printing apparatus 1 performs printing, the driver 10 relatively moves the medium 100 with respect to the head 4 while drawing the medium wounded around the medium feeding roller 13. The direction in which the driver 10 moves the medium 100 with respect to the head 4 is a sub scan direction (an X direction in the drawings) which is a direction perpendicular to both of the main scan direction and an up and down direction (a Z direction in the drawings) in the normal use mode of the printing apparatus 1.

The driver 10 which moves the medium 100 in the sub scan direction includes a drive roller 11 which draws the medium 100 from the medium feeding roller 13 and conveys the medium 100 to a side of the head 4, and a winding roller 12 which winds the medium 100 after ink is ejected from the head 4. All of the drive roller 11, the winding roller 12, and the medium feeding roller 13 are composed of rollers having rotating shafts which are disposed in the main scan direction. Also, the medium feeding roller 13 and the winding roller 12 are disposed below the platen 7. Therefore, the medium 100 is disposed from the lower side toward the upper side over an area from the medium feeding roller 13 to the platen 7, and is disposed from the upper side toward the lower side over an area from the platen 7 to the winding roller 12.

Both of the drive roller 11 and the winding roller 12 included in the driver 10 are configured to be able to receive power from an electric motor (not shown) which is a power source, and be rotatable by power transmitted from the electric motor. Their rotation directions are directions making it possible to convey the medium 100 from the drive roller 11 to the winding roller 12 through the gap between the head 4 and the platen 7, and the rotation speed of the winding roller 12 is higher than the rotation speed of the drive roller 11.

Also, the drive roller 11 is configured to be able to rotate on the rotating shaft while bringing the outer circumferential surface into contact with the medium 100, thereby conveying the medium 100 being in contact with the outer circumferential surface to a side of the head 4. As described above, at a position where the outer circumferential surface of the drive roller 11 comes into contact with the medium 100, on the opposite side of the medium 100 to the side which comes into contact with the outer circumferential surface of the drive roller 11, a driven roller 14 is disposed such that its outer circumferential surface comes into contact with the medium 100, similarly to the drive roller 11. In other words, the medium 100 is threaded from the medium feeding roller 13 toward the gap between the head 4 and the platen 7 through the gap between the drive roller 11 and the driven roller 14. While the driven roller 14 rotates according to movement of the medium 100 attributable to rotation of the drive roller 11, it comes into contact with the medium 100, thereby applying a biasing force in a direction for pressing the medium 100 against the drive roller 11.

The winding roller 12 is positioned on the downstream side from the platen 7 in the movement direction of the medium 100 which is moved by the driver 10, that is, the conveyance direction of the medium 100, and is configured to be able to wind the medium 100 which is fed by the drive roller 11.

Between the winding roller 12 and the platen 7, a positioning roller 15 is provided so as to apply a biasing force to the medium 100, thereby tensioning a portion of the medium 100 which is positioned between the positioning roller 15 and the platen 7. At a position on the downstream side from the platen 7 in the conveyance direction of the medium 100, the positioning roller 15 comes into contact with, for example, a surface of the medium 100 on the side being in contact with the platen 7, thereby applying the biasing force to the medium 100. Since the winding roller 12 is disposed on the downstream side from the positioning roller 15 in the conveyance direction of the medium 100, in an area which is positioned on the downstream side from the platen 7 in the conveyance direction of the medium 100, the upstream side and downstream side of the positioning roller 15 differ in the conveyance direction. The path which starts from the medium feeding roller 13, passes through the gap between the drive roller 11 and the driven roller 14, passes the top of the platen 7, and leads to the winding roller 12 through the positioning roller 15 is a conveyance path 8 which is a path in which the medium 100 is conveyed.

The dryer 20 included in the printing apparatus 1 according to the present embodiment is disposed on the downstream side from an area where the head 4 is disposed, in the conveyance direction of the medium 100, so as to face the surface of the medium 100 to which ink ejected from the head 4 attaches. More specifically, the dryer 20 is disposed so as to face a portion of the medium 100 which is positioned between the head 4 and the positioning roller 15 in the conveyance direction of the medium 100. In other words, the dryer 20 is disposed so as to face a portion of the medium 100 disposed from the upper side toward the lower side in a portion of the conveyance path from the platen 7 toward the positioning roller 15 and the winding roller 12. Also, the width of the dryer 20 in the main scan direction is set to a width larger than the width of the medium 100 in the main scan direction.

The dryer 20 includes a first heating element 21, and a second heating element 22 which is disposed below the first heating element 21. In other words, the second heating element 22 is disposed on the downstream side from the first heating element 21 in the conveyance direction of the medium 100. The first heating element 21 and the second heating element 22 are formed so as to extend in the main scan direction, and are connected to each other by a hinge 23 which is a rotator which rotates on a rotating shaft extending in the main scan direction of the head 4. The hinge 23 is connected to a lower end portion of the first heating element 21 and an upper end portion of the second heating element 22 such that the rotating shaft is disposed in a direction perpendicular to the conveyance direction of the medium 100, whereby the first heating element 21 and the second heating element 22 become able to relatively rotate on the rotating shaft of the hinge 23. Since the first heating element 21 and the second heating element 22 become able to relatively rotate by the hinge 23 as described above, the dryer 20 becomes able to expand and contract in a direction along the conveyance path 8.

The first heating element 21 and the second heating element 22 have cover members 25 on their sides facing the medium 100. The cover members 25 are formed so as to be divided into at least a first cover part 26 which is a first segment and a second cover part 27 which is a second segment, in the conveyance direction of the medium 100, and are placed on the downstream side from the head 4 in the conveyance direction of the medium 100 so as to cover at least a portion of the medium 100. In other words, the cover members 25 are formed so as to cover at least a portion of the conveyance path 8 for conveying the medium 100, and cover a portion of the conveyance path 8 to which the medium 100 after inkjet printing is conveyed. The cover members 25 are configured such that at least a portion of a part which covers the conveyance path 8 can expand and contract according to relative rotation of the first heating element 21 and the second heating element 22.

Specifically, the first cover part 26 is provided on a face of the first heating element 21 facing the medium 100, and the second cover part 27 is provided on a face of the second heating element 22 facing the medium 100. Both of the first cover part 26 and the second cover part 27 are formed by sheet-metal members, and are turned such that their plate thickness directions become close to the thickness direction of the medium 100, and are disposed so as to face the medium 100. Since the cover members 25 which are provided as described above are provided on the first heating element 21 and the second heating element 22 to which the hinge 23 is connected, it can be said that the hinge 23 is connected to the cover members 25. The hinge 23 is provided such that the first cover part 26 and the second cover part 27 can be folded. In this way, the first cover part 26 and the second cover part 27 are connected by the hinge 23 disposed therebetween, so as to be able to relatively rotate with respect to each other, and at least one of them is configured to be able to retreat from a position for covering the conveyance path 8 by relatively rotating by the hinge 23.

Also, in the first heating element 21, air blowers 40 are provided so as to blow air to a space between the dryer 20 and the medium 100. Each air blowing unit 40 has an air outlet 61 formed in a surface facing the medium 100, that is, a surface facing the platen 7, and can blow air from the air outlet 61 to the space between the dryer 20 and the medium 100. The air outlet 61 of each air blowing unit 40 is formed in the vicinity of the upper end of a surface of the dryer 20 facing the medium 100.

The air blowers 40 which are formed as described above include the air blowing fans 45 which are air blowers, and air-flow-direction changing wall parts 60 which are provided on the air flow path of the air blowing fans 45 and change the flow direction of air blown from the air blowing fans 45. Of them, the air blowing fans 45 are provided as drying-air-flow supply which cause the drying air flow Fd (see FIG. 4) for drying ink ejected on the medium 100 to flow between the medium 100 and the cover members 25. If electric power is supplied to the air blowing fans 45, the air blowing fans become able to operate to create wind inside the air blowers 40, thereby blowing the preliminary air Ap (see FIG. 4) which is the previous stage of the drying air flow Fd.

Also, the air-flow-direction changing wall parts 60 are provided as flow path changer for changing the flow direction of the preliminary air Ap which is the previous stage of the drying air flow Fd. Specifically, the air-flow-direction changing wall parts 60 are provided above the air blowing fans 45, such that the preliminary air Ap blown from the air blowing fans 45 can collide with the air-flow-direction changing wall parts 60, whereby the flow direction can be changed. In this way, the air-flow-direction changing wall parts 60 can change the flow direction of the preliminary air Ap blown upward from the air blowing fans 45, thereby directing the wind toward the air outlets 61. In other words, the air-flow-direction changing wall parts 60 direct air blown from the air blowing fans 45 downward, thereby directing the wind created in the air blowers 40 toward the air outlets 61, and send the wind out from the air outlets 61, thereby sending the wind as the drying air flow Fd toward the gap between the medium 100 and the cover members 25.

Also, in the dryer 20, cord type heaters 28 are provided as heater for heating air blown from the air blowing fans 45 or/and the cover members 25. The cord type heaters 28 are bonded to the opposite surfaces of the cover members 25 to their surfaces facing the medium 100, and are bonded to both of the first cover part 26 and the second cover part 27. The cord type heaters 28 which are bonded to the cover members 25 as described above can heat the cover members 25, thereby heating the drying air flow Fd blown toward the gap between the medium 100 and the cover members 25 by the air blowers 40. The cord type heaters 28 can heat the drying air flow Fd as described above, thereby heating the area positioned between the medium 100 and the cover members 25.

In the printing apparatus 1, between the air outlets 61 which are formed at the dryer 20 and the head 4 which is provided in the printing apparatus main body 2, a partition plate 18 is provided to separate the air outlets 61 and the head 4. The partition plate 18 is provided in the printing apparatus main body 2 so as to be positioned above the platen 7 and on the downstream side from the head 4 in the conveyance direction of the medium 100. When the medium 100 is mounted on the platen 7 and is conveyed from a side of the head 4 to the side where the positioning roller 15 and the winding roller 12 are positioned, the medium is conveyed through the gap between the partition plate 18 and the platen 7.

Figure 3:
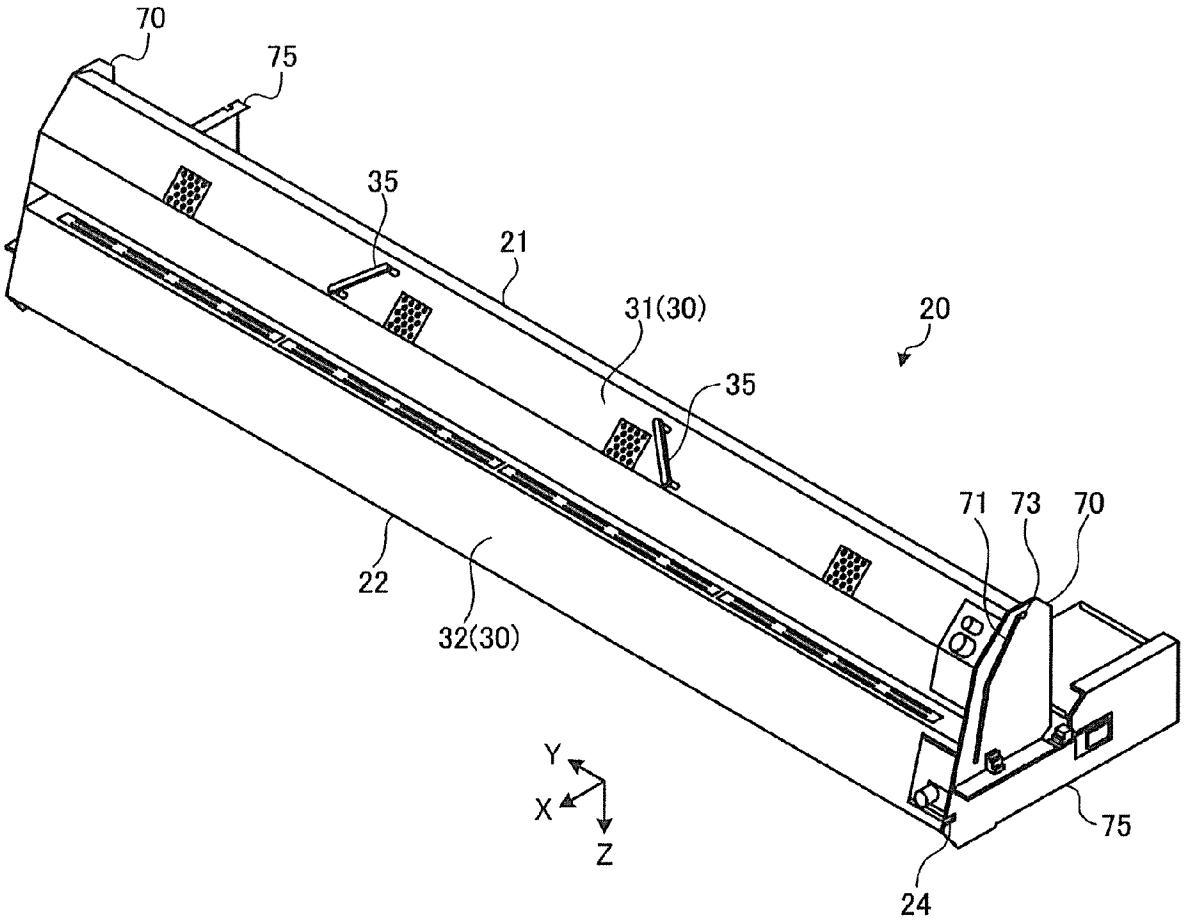
FIG. 3 is a perspective view of a dryer shown in FIG. 1.
Figure 4:
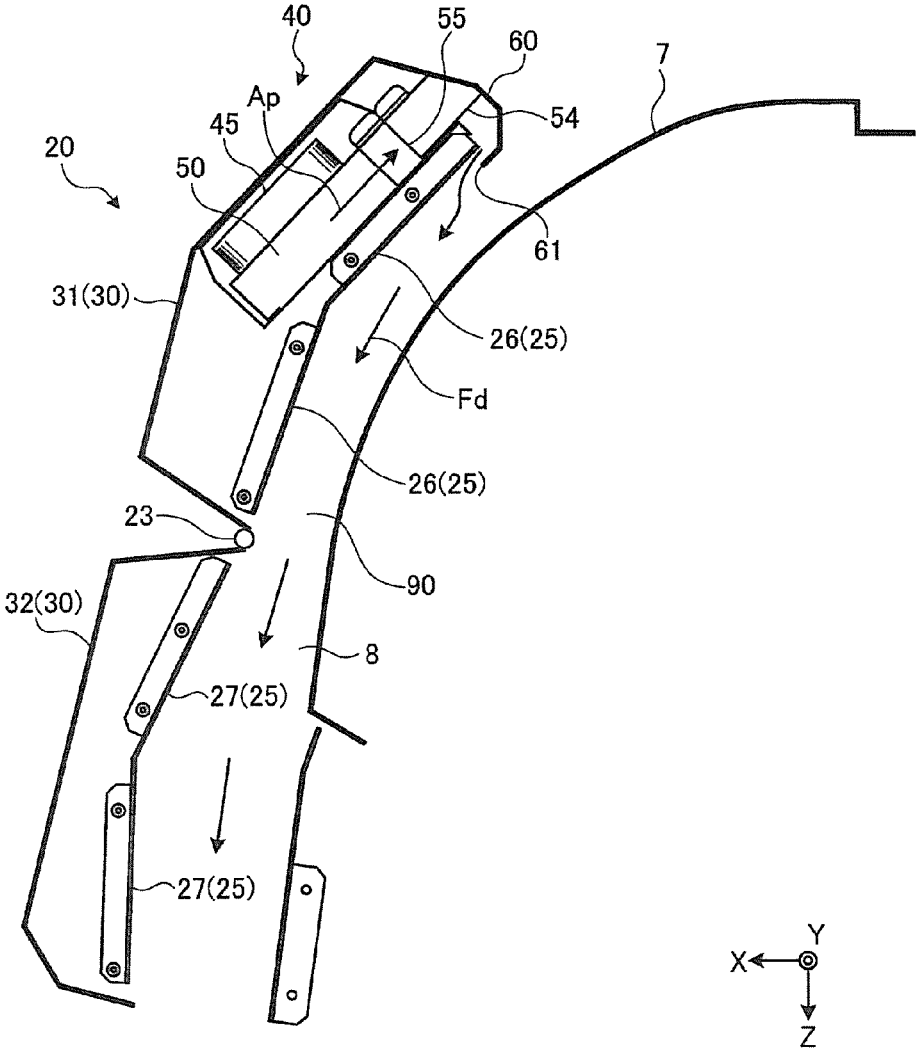
FIG. 4 is a cross-sectional view as the dryer shown in FIG. 3 is seen in a main scan direction.

FIG. 3 is a perspective view of the dryer shown in FIG. 1. FIG. 4 is a cross-sectional view as the dryer shown in FIG. 3 is seen in the main scan direction. The dryer 20 is assembled with the printing apparatus main body 2 by fixing members 75 which are disposed on both ends of the dryer 20 in the main scan direction. The fixing members 75 are provided on two portions on both sides of the dryer 20 in the main scan direction, and extend from both end portions of the dryer 20 toward the side where the printing apparatus main body 2 is positioned, as seen from the dryer 20.

In the dryer 20, at both end portions of the second heating element 22 in the main scan direction, rotation connection parts 24 are provided as rotating shafts so as to be close to the lower end of the second heating element 22. The rotation connection parts are connected to the fixing members 75, so as to be rotatable. Since the rotation connection parts 24 are formed so as to protrude in the main scan direction, the second heating element 22 connected to the fixing members 75 by the rotation connection parts 24 is rotatable on the axial center of the rotation connection parts 24 extending in the main scan direction.

Also, on the portions of the fixing members 75 which are connected to the rotation connection parts 24, side plates 70 are attached as guide plates. Like the fixing members 75, the side plates 70 are provided at two portions on both sides of the dryer 20 in the main scan direction. On the first heating element 21, guide supporting parts 73 are provided so as to be close to the upper ends of both end portions of the first heating element 21 in the main scan direction and protrude in the main scan direction. As described above, the guide supporting parts 73 which are provided on the first heating element 21 and the rotation connection parts 24 which are provided on the second heating element 22 are disposed on both sides of the cover members 25, respectively, with the hinge 23 interposed therebetween in the conveyance direction of the medium 100. In other words, on one side of the cover members 25 relative to the hinge 23 in the conveyance direction of the medium 100, the rotation connection parts 24 are provided, and on the other side, the guide supporting parts 73 are provided.

Also, in the side plates 70, folding/unfolding guides 71 constituting guide device 78 together with the side plates 70 and the guide supporting parts 73 are formed as guiding parts for inserting the guide supporting parts 73. The folding/unfolding guides 71 are formed, in a slit shape, as guide parts for guiding the guide supporting parts 73, thereby guiding the first heating element 21 during rotation, when the first heating element 21 relatively rotates with respect to the second heating element 22 by the hinge 23. In other words, the folding/unfolding guides 71 are configured to guide the guide supporting parts 73 during expansion or contraction of the cover members 25. In the cover members 25, the first cover part 26 and the second cover part 27 are supported to be able to expand and contract by the guide device 78 including the guide supporting parts 73 provided on the first heating element 21 and the rotation connection parts 24 provided on the second heating element 22.

Also, the first heating element 21 and the second heating element 22 have heating element covers 30 as their covers. The heating element covers 30 are provided on the opposite faces of the first heating element 21 and the second heating element 22 to their faces where the cover members 25 are provided. Specifically, on the first heating element 21, a first heating element cover 31 is provided as a heating element cover 30, and on the second heating element 22, a second heating element cover 32 is provided as a heating element cover 30.

The first heating element cover 31 and the second heating element cover 32 are formed so as to cover the opposite faces of the first heating element 21 and the second heating element 22 to their faces where the cover members 25 are provided, respectively. On the first heating element cover 31 of the first heating element cover 31 and the second heating element cover 32, handles 35 are provided such that a user of the printing apparatus 1 can hold them to rotate the first heating element 21 and the second heating element 22. The handles 35 are provided at two portions positioned on the upper half of the first heating element cover 31, and the two handles 35 are provided almost in an inverted V shape so as to be symmetric with respect to the center of the first heating element cover 31 in the main scan direction. In other words, the two handles 35 are positioned such that the user can easily hold them with both hands.

Also, the air blowers 40 are disposed inside the first heating element cover 31, so as to be close to the upper end of the inside of a space which is defined by the first heating element cover 31 and the first cover part 26. The upper end portion of the first heating element cover 31 is provided as the air-flow-direction changing wall parts 60. Between the air blowing fans 45 and the air-flow-direction changing wall parts 60, widening ducts 50 and current plates 55 (to be described below) are provided.

Also, the upper end portion of the first heating element cover 31 is formed to be curved to the side where the first cover part 26 is positioned and be closer to the platen 7 than the first cover part 26 is. Therefore, on a face of the first heating element 21 on a side of the first cover part 26, between the first cover part 26 and a portion of the first heating element cover 31 closer to the platen 7 than the first cover part 26 is, a gap is formed. This gap is formed as the air outlets 61. Since the air outlets 61 are formed by the first cover part 26 and a portion of the first heating element cover 31 near its upper end as described above, the air outlets 61 are open substantially downward, and connect the inside and outside of the first heating element 21.

In the dryer 20 having the air outlets 61 formed on the face positioned on a side of the platen 7 as described above, a space which is defined by the platen 7 and a face of the dryer where the cover members 25 are positioned is formed as an air flow path 90 of a wind sent out from the air outlets 61.

Figure 5:
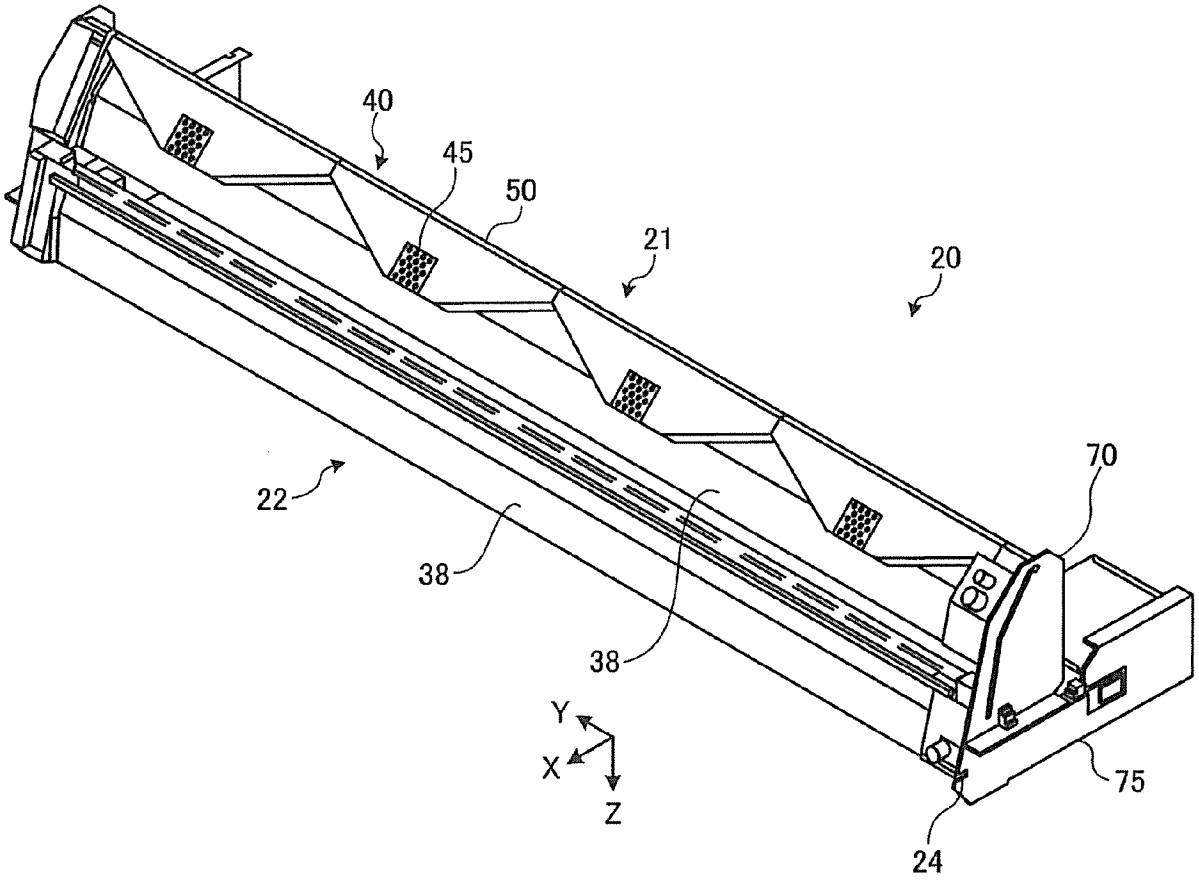
FIG. 5 is a perspective view illustrating the dryer shown in FIG. 3 without heating element covers.

FIG. 5 is a perspective view illustrating the dryer shown in FIG. 3 without the heating element covers. Inside the first heating element 21 and the second heating element 22, at portions closer to the heating element covers 30 than to the cover members 25, heat insulating materials 38 are disposed. The heat insulating materials 38 are formed such that heat conductivity becomes low, and are disposed inside the first heating element 21 and the second heating element 22 so as to cover the whole cover members 25.

Also, the plurality of air blowers 40 is provided in a line in the main scan direction inside the first heating element 21, and each air blowing unit 40 includes an air blowing fan 45 and a widening duct 50. Each widening duct 50 is formed in a fan shape for spreading the preliminary air Ap, blown from the air blowing fan 45, in a direction perpendicular to the movement direction of the medium 100, that is, the main scan direction. Specifically, an air blowing fan 45 is attached to each widening duct 50, and each widening duct 50 is formed in a fan shape which widens in the main scan direction as it goes from a position where the air blowing fan 45 is disposed toward the upper end side of the first heating element 21. Since each widening duct 50 is formed in a fan shape as described, the plurality of widening ducts 50 are disposed inside the first heating element 21 so as to be continuous in the main scan direction.

Figure 6:
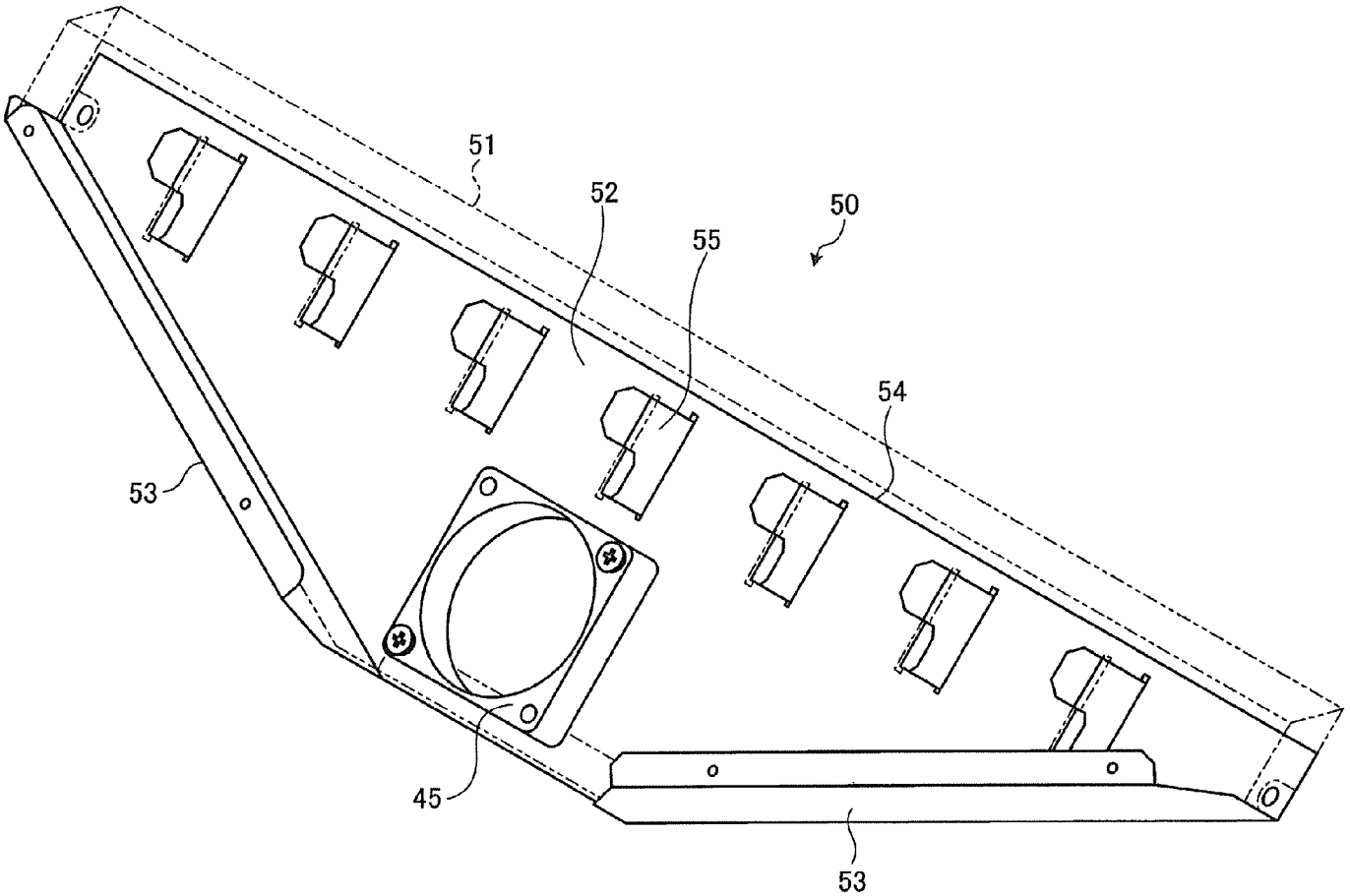
FIG. 6 is a perspective view of a widening duct shown in FIG. 5.

FIG. 6 is a perspective view of a widening duct shown in FIG. 5. The widening duct 50 is formed by assembling a fan side member 51 to be positioned on a side of the first heating element cover 31 and an air outlet side member 52 to be positioned on a side of the first cover part 26. The fan side member 51 and the air outlet side member 52 are formed in fan shapes or trapezoidal shapes, and their shapes as they are seen substantially in the sub scan direction are similar to each other. The fan side member 51 and the air outlet side member 52 are assembled, whereby the widening duct 50 is formed so as to have an internal space. Also, at both ends of a portion of the widening duct 50 widening in the main scan direction, inclined surfaces 53 are provided so as to stand in the thickness direction of the first heating element 21, and the internal space of the widening duct 50 is closed with respect to the main scan direction by the inclined surfaces.

Meanwhile, as for the heights of the trapezoidal shapes which are the shapes of the fan side member 51 and the air outlet side member 52, the height of the air outlet side member 52 is lower than the height of the fan side member 51. Also, in an end portion of the fan side member 51 on the wider side of the widening duct 50, a wall surface is formed so as to stand in the thickness direction of the first heating element 21. A portion which is defined by an end portion of the air outlet side member 52 on the wider side and a wall surface provided at the end portion on the wider side of the fan side member 51 so as to stand in the thickness direction of the first heating element 21 becomes a widening-duct opening 54 which is an opening of the widening duct 50. The internal space of the widening duct 50 is connected to the outside of the widening duct 50 through the widening-duct opening 54. The widening duct 50 is attached to the first heating element 21, such that the widening-duct opening 54 is positioned in the vicinity of the air outlet 61 and the widening-duct opening 54 and the air outlet 61 are connected. An air blowing fan 45 is attached to the fan side member 51 so as to be able to blow air to the internal space of the widening duct 50.

Also, the wall surfaces provided at the end portions of the fan side members 51 of the widening ducts 50 on the wider side so as to stand in the thickness direction of the first heating element 21, and the upper end portion of the first heating element cover 31 constitute the air-flow-direction changing wall parts 60. To this end, the widening-duct openings 54 are formed adjacent to the air-flow-direction changing wall parts 60.

Inside each widening duct 50 which is formed as described above, in the vicinity of the wider end portion, that is, in the vicinity of the widening-duct opening 54, a plurality of current plates 55 extending in the flow direction of the preliminary air Ap blown from the air blowing fan 45 is provided side by side in the width direction. The current plates 55 are provided over a portion between the fan side member 51 and the air outlet side member 52 such that the thickness direction is aligned with the widening direction of the widening duct 50 and the width direction is aligned with the height direction of the trapezoidal shapes which are the shapes of the fan side member 51 and the air outlet side member 52.

Figure 7:
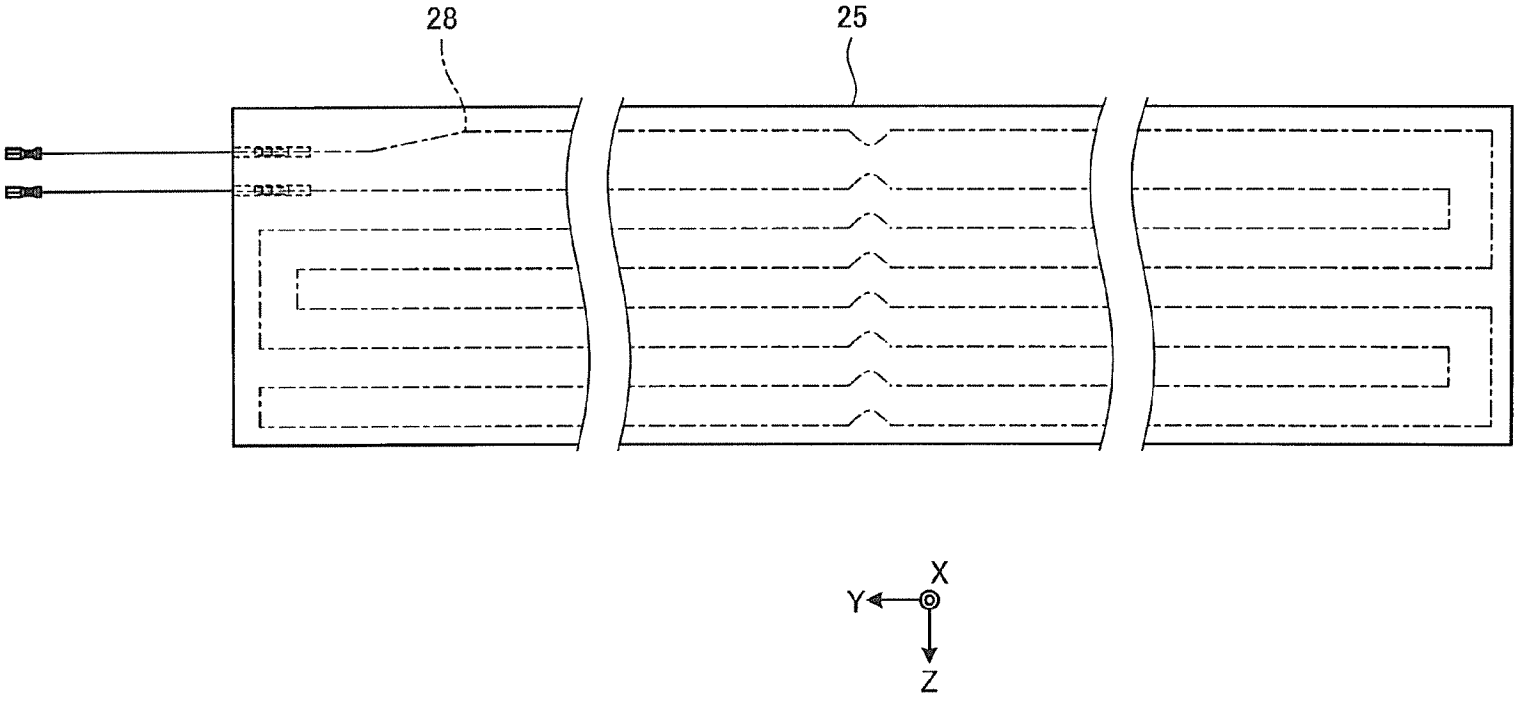
FIG. 7 is a plan view of a cover member shown in FIG. 4.

FIG. 7 is a plan view of a cover member shown in FIG. 4. The cord type heaters 28 which are bonded to the cover members 25 are provided throughout the width direction of the medium 100 in the direction perpendicular to the movement direction of the medium 100. Specifically, the cord type heaters 28 are disposed along the main scan direction on the cover members 25 and are turned in the vicinities of the end portions of the cover members 25 in the main scan direction, such that portions along the main scan direction are disposed in parallel in an up and down direction. In this way, the cord type heaters 28 are disposed over the entire areas of the cover members 25, that is, the cord type heaters 28 are disposed over the entire areas of both of the first cover part 26 and the second cover part 27.

The dryer 20 and the printing apparatus main body 2 which are configured as described above are controlled by a control unit (not shown) which is provided in the printing apparatus main body 2. The control unit is a unit for controlling each unit of the printing apparatus 1, and includes a central processing unit (CPU) which functions as a controller for performing various processes, a random access memory (RAM) and a read only memory (ROM) for storing a variety of information, and so on. The control unit performs control on printing of the printing apparatus main body 2 on the medium 100 and an operation of the dryer 20 for drying the printed medium 100.

The printing apparatus 1 according to the present embodiment is configured as described above, and the effects of the printing apparatus will be described below. On the occasion of performing printing on the medium 100, the medium 100 wound around the medium feeding roller 13 like a roll is drawn from the medium feeding roller 13, and passes through the gap between the head 4 and the platen 7. In a state where the medium 100 has been disposed between the medium feeding roller 13 and the winding roller 12, the printing apparatus 1 performs printing.

Figure 8:
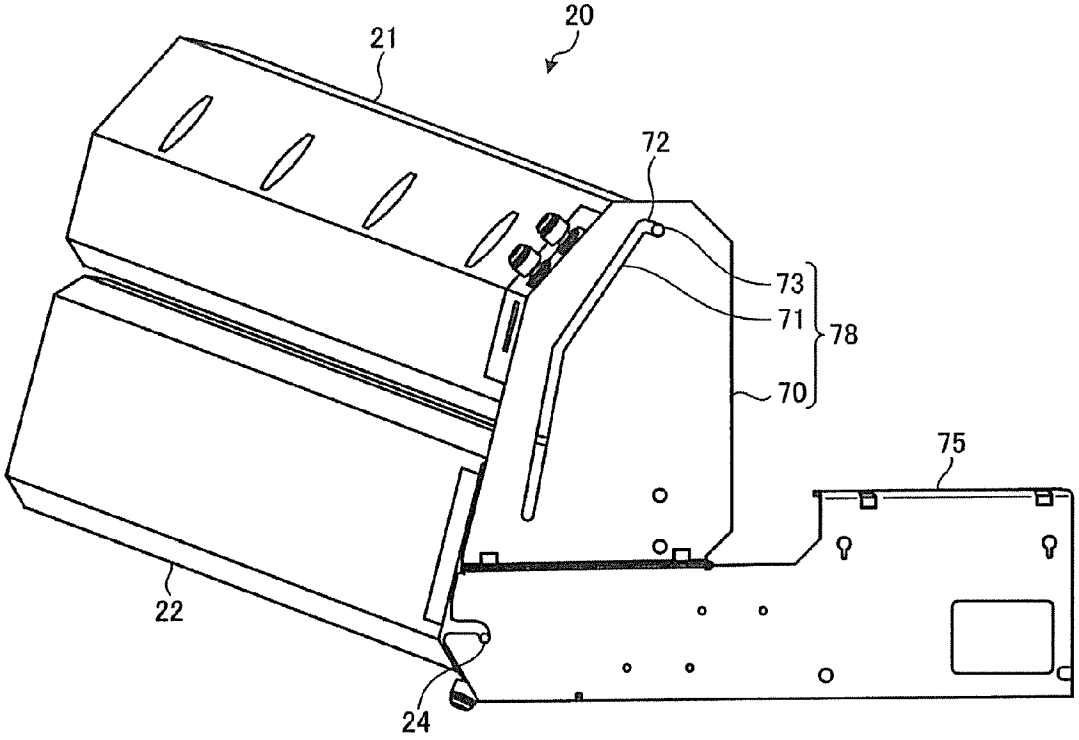
FIG. 8 is a perspective view illustrating the state of the dryer when the printing apparatus performs printing.

FIG. 8 is a perspective view illustrating the state of the dryer when the printing apparatus performs printing. Also, on the occasion of performing printing using the printing apparatus 1, the dryer 20 in which the first heating element 21 and the second heating element 22 can relatively rotate is controlled, such that the first heating element 21 and the second heating element 22 are unfolded, whereby the cover members 25 of them face the medium 100. Specifically, the guide supporting parts 73 provided on the first heating element 21 are positioned at engagement portions 72 which are positions in the folding/unfolding guides 71 formed in the side plates 70 and where the guide supporting parts 73 are inserted to unfold the first heating element 21 and the second heating element 22. As a result, the dryer 20 becomes a state where the first heating element 21 and the second heating element 22 are unfolded and the first cover part 26 and the second cover part 27 face the medium 100.

The printing apparatus 1 performs printing on the medium 100 by ejecting ink from the head 4 onto the medium 100. At this time, the control unit moves the head 4 along the Y bar 5, thereby moving the head 4 back and forth in the main scan direction. Therefore, the head 4 ejects ink onto the medium 100 placed on the platen 7 while reciprocating in the main scan direction, such that the ink lands on the medium 100, thereby performing printing on the medium 100.

After printing is performed on a predetermined range in the main scan direction by the head 4, the control unit controls the driver 10, thereby operating the drive roller 11 and the winding roller 12 to move the medium 100 from a side of the medium feeding roller 13 toward a side of the winding roller 12 by a predetermined movement amount. In other words, the control unit performs control such that the medium 100 moves with respect to the head 4 in the sub scan direction by the predetermined movement amount. After the medium 100 moves, the control unit re-performs control such that the head 4 is moved in the main scan direction while ink is ejected from the head 4, whereby printing is performed on the predetermined range in the main scan direction. The printing apparatus 1 repeats the above described operation, thereby performing printing on the medium 100.

Since the printing apparatus 1 performs printing while conveying the medium 100 in the sub scan direction as described above, the medium 100 after landing of ink is conveyed to a position facing the dryer 20. During printing of the printing apparatus 1, in the dryer 20, while the cord type heaters 28 generate heat, the air blowing fans 45 create wind by the preliminary air Ap. In the case where the cord type heaters 28 generate heat, the heat generated by the cord type heaters 28 is transferred to the cover members 25, and the transferred heat is transferred throughout the cover members 25 composed of a metal material. Therefore, the temperatures of the whole cover members 25 rise.

Also, the flow direction of the preliminary air Ap blown from the air blowing fans 45 by the air blowing fans 45 is changed by the air-flow-direction changing wall parts 60, such that the preliminary air flows toward the gap between the medium 100 and the cover members 25. Specifically, the preliminary air Ap blown from the air blowing fan 45 flows into the widening ducts 50. Since the widening ducts 50 have the widening-duct openings 54 formed at their end portions on the wider side, the preliminary air Ap entering the widening ducts 50 flows toward the widening-duct openings 54, that is, toward the end portions on the wider side.

Since the plurality of current plates 55 is disposed inside the widening ducts 50, the preliminary air Ap flowing in the widening ducts 50 toward the widening-duct openings 54 positioned on the wider side passes through the current plates 55, thereby being rectified. In other words, the preliminary air Ap flowing in the widening ducts 50 is rectified by the current plates 55, whereby turbulence of the flow is reduced, and in this state, the preliminary air smoothly flows in the widening ducts 50 toward the end portions.

If the preliminary air Ap flows in the widening ducts 50 as described above, thereby reaching a side of the widening-duct opening 54 positioned on the wider side of the widening ducts 50, the preliminary air is sent out from the widening ducts 50 through the widening-duct openings 54 positioned near the air-flow-direction changing wall part 60.

The preliminary air Ap flowing from the widening ducts 50 to the outside of the widening ducts 50 through the widening-duct openings 54 is guided to the air-flow-direction changing wall parts 60 of the first heating element cover 31 while flowing toward the air outlets 61. The air flowing toward the air outlets 61 passes through the air outlets 61, thereby flowing from the inside of the first heating element 21 to the outside of the first heating element 21. Since the air outlets 61 are open substantially downward, the air flowing out from the air outlets 61 flows downward. Therefore, the preliminary air Ap flowing out from the air outlet 61 flows, as the drying air flow Fd for drying ink ejected on the medium 100, toward the gap between the medium 100 and the cover members 25.

Since the air blowing fans 45 blow air only inside the widening ducts 50, whereby the preliminary air Ap in the widening ducts 50 is sent out from the widening-duct openings 54, the flow direction of all of the air which is sent from the air blowing fans 45 toward the gap between the medium 100 and the cover members 25 is changed by the air-flow-direction changing wall parts 60. In other words, the flow direction of the preliminary air Ap sent from the air blowing fans 45 is changed by the air-flow-direction changing wall part 60, whereby the preliminary air flows as the drying air flow Fd into the air flow path 90 between the medium 100 and the cover members 25.

As described above, since the temperatures of the cover members 25 which constitute the air flow path 90 together with the medium 100 are increased by heat generation of the cord type heaters 28, the temperature of the drying air flow Fd which flows in the air flow path 90 also rises due to radiant heat from the cover members 25. In the air flow path 90, the air blown from the air blowing fans 45 is sequentially sent downward from the air outlets 61 while air heated by radiant heat from the cover members 25 tends to move upward. Therefore, the drying air flow Fd in the air flow path 90 is agitated while being heated.

During printing of the printing apparatus 1, after ink ejected from the head 4 lands on the medium 100, the medium is conveyed from the top of the platen 7 toward the winding roller 12 by the driver 10, thereby moving into the air flow path 90. Ink on the medium 100 moving into the air flow path 90 after landing of ink ejected from the head 4 may be wet still. However, since the drying air flow Fd in the air flow path 90 has been heated and agitated, the whole of a portion of the medium 100 which is positioned in the air flow path 90 is heated by the drying air flow Fd having been heated and agitated while steam arising from the ink is removed. Therefore, if ink is ejected from the head 4 and lands on a portion of the medium 100, and the portion of the medium 100 is positioned in the air flow path 90, the ink appropriately dries.

Also, most of air flowing from the air outlet 61 of the dryer 20 into the air flow path 90 flows downward. However, in some cases such as a case where the volume of air is large, the flow of the air may become turbulent, thereby flowing upward. In this case, it can be considered that a portion of the air flows toward the head 4 of the printing apparatus main body 2. Even in this case, since the printing apparatus main body 2 has the partition plate 18 which separates the air outlets 61 and the head 4, the air flowing toward the head 4 is blocked by the partition plate 18.

After ink on the medium 100 is dried by the drying air flow Fd flowing from the dryer 20 into the air flow path 90, the medium is sequentially conveyed by the driver 10, toward the winding roller 12 and is wound around the winding roller 12. When the printing apparatus 1 performs printing on the medium 100, as described above, printing is performed by the printing apparatus main body 2 while the medium 100 is conveyed, and ink on the medium 100 is dried by the dryer 20. In this way, printing is continuously performed on the roll-like medium 100.

Also, in the above described embodiment, air flowing into the air flow path 90 is heated by the heaters provided on the cover members 25. However, the heater is not limited to the heaters provided on the cover members 25, and a method of directly heating an air flow, such as a method of heating an air flow by a heater before or after the direction of the air flow is changed by the air-flow-direction changing wall parts 60 can be applied.

Figure 9:
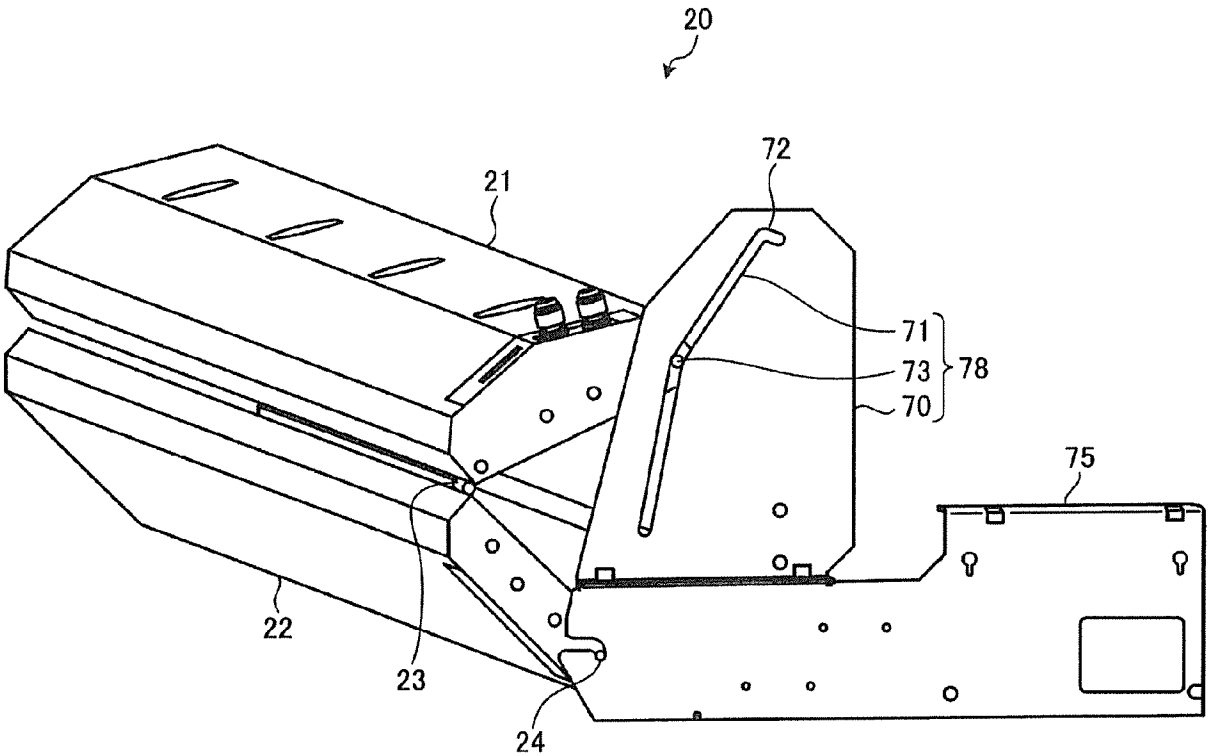
FIG. 9 is a perspective view illustrating the dryer in a case of folding the dryer shown in FIG. 8.

In a case where printing of the printing apparatus 1 has finished, the dryer 20 is closed if necessary. FIG. 9 is a perspective view illustrating the dryer in a case of folding the dryer shown in FIG. 8. In the case of folding the dryer 20, the user holds the handles 35 provided on the first heating element 21 and draws them up, thereby relatively rotating the first heating element 21 with respect to the second heating element 22 such that the guide supporting parts 73 of the first heating element 21 engaged with the engagement portions 72 forming in the folding/unfolding guides 71 of the side plates 70 move along the folding/unfolding guides 71.

Specifically, the guide supporting parts 73 are moved downward along the folding/unfolding guides 71, whereby the first cover part 26 and the second cover part 27 rotate so as to be almost horizontal. In this case, the second cover part 27 relatively rotates on the rotation connection parts 24 with respect to the fixing members 75, and the first cover part 26 relatively rotates with respect to the second cover part 27 by the hinge 23. In this way, the first cover part 26 and the second cover part 27 rotate toward each other so as to come close.

Figure 10:
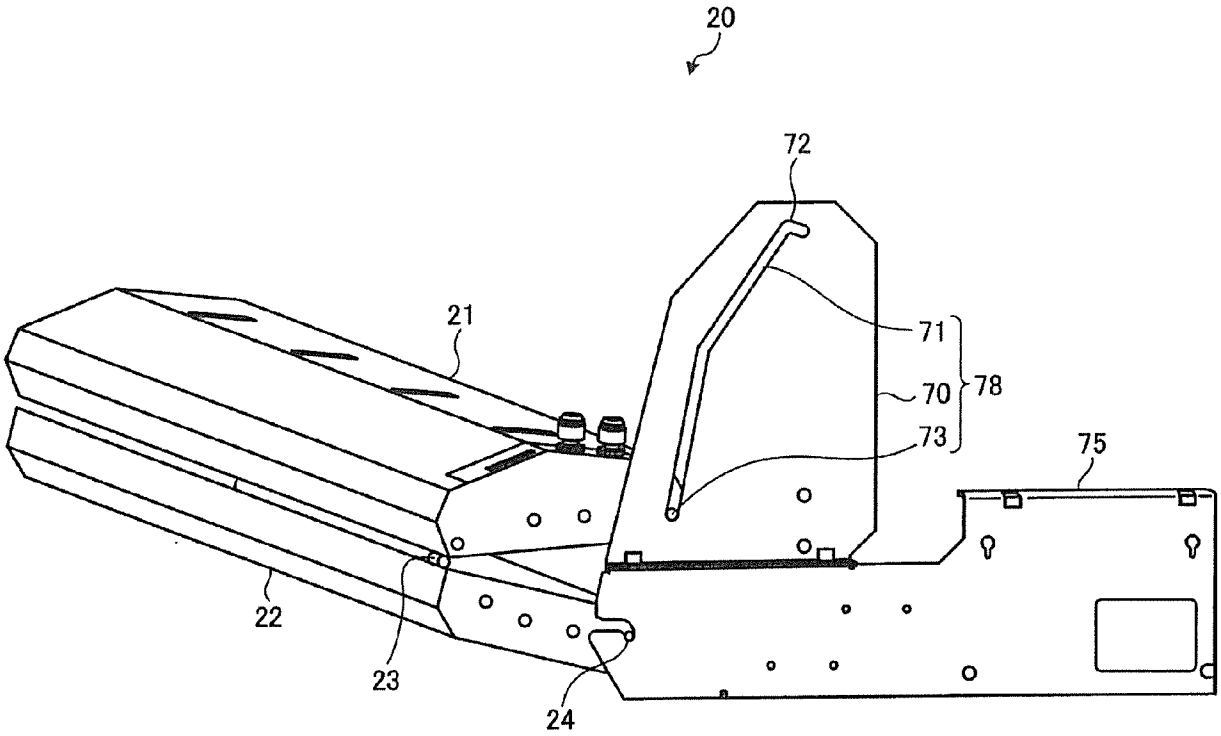
FIG. 10 is a perspective view illustrating the dryer shown in FIG. 9 in a state where the dryer is folded.

FIG. 10 is a perspective view illustrating the dryer shown in FIG. 9 in a state where the dryer is folded. If the first heating element 21 and the second heating element 22 are relatively rotated, whereby the guide supporting parts 73 provided on the first heating element 21 reach the lower ends of the folding/unfolding guides 71 formed in the side plates 70, the guide supporting parts 73 cannot be moved downward from the lower ends of the folding/unfolding guides. This state of the dryer 20 is the state where the first heating element 21 and the second heating element 22 are folded. The first heating element 21 and the second heating element 22 which can be folded as described above are configured by connecting them by the hinge 23 such that the cover members 25 do not protrude into the conveyance path 8 during expansion or contraction of the cover members 25. Therefore, the first heating element 21 and the second heating element 22 relatively rotate such that, when the first heating element 21 and the second heating element 22 are folded, thereby contracting in the conveyance direction of the medium 100, their end portion sides connected to the hinge 23 move away from the platen 7. Therefore, in a state where the first heating element 21 and the second heating element 22 are folded, since the first cover part 26 faces substantially downward, and the second cover part 27 faces substantially upward, the first cover part 26 and the second cover part 27 substantially face each other. In other words, in the dryer 20, when the first heating element 21 and the second heating element 22 are folded, the first cover part 26 and the second cover part 27 are positioned on the inner side.

Figure 11:
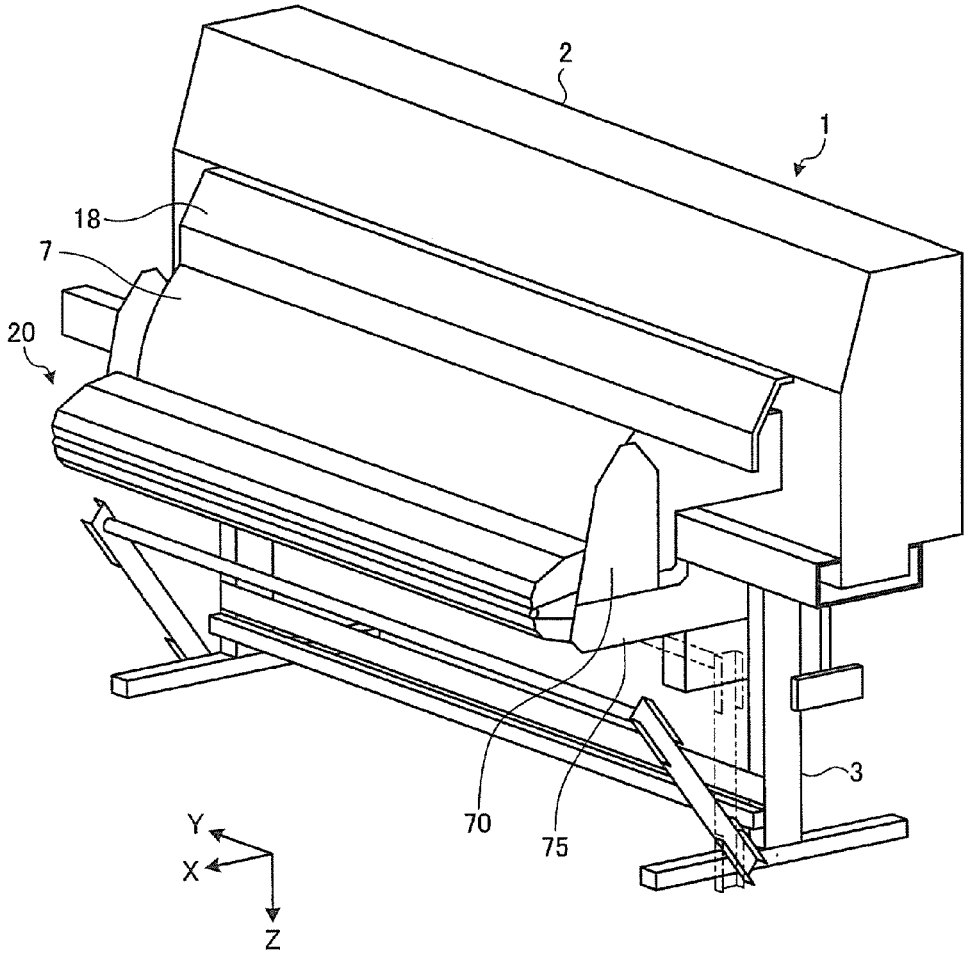
FIG. 11 is a perspective view illustrating the printing apparatus in a state where the dryer is folded.

FIG. 11 is a perspective view illustrating the printing apparatus in a state where the dryer is folded. In a case where the cover members 25 are contracted in the conveyance direction of the medium 100, whereby the dryer 20 is folded, the first cover part 26 and the second cover part 27 retreat from positions where at least one of them covers the conveyance path 8. As a result, in the printing apparatus 1, a portion of the platen 7 of the printing apparatus main body 2 positioned on a side of the dryer 20 is exposed. Therefore, in the case where the dryer 20 is folded, it is easy to perform maintenance such as a process of drawing the medium 100 from the printing apparatus main body 2 onto the platen 7, and setting the medium 100 around the winding roller 12 through the positioning roller 15. Especially, in the case of providing the partition plate 18, since it is difficult for a worker to touch the platen 7, contraction of a portion of the cover members 25 from the position for covering the conveyance path 8 has a greater effect.

On the occasion of setting the medium 100 in the printing apparatus main body 2 and starting printing, the cover members 25 expand in the conveyance direction of the medium 100, whereby the first heating element 21 and the second heating element 22 are unfolded such that a portion of the conveyance path 8 is covered by the cover members 25 (see FIG. 4). In this state, printing is performed. Also, it is preferable that the dryer 20 should include a biasing unit such as a spring for applying a biasing force for unfolding to the first heating element 21 and the second heating element 22 folded. In this case, it is possible to assist the initial motion when the first heating element 21 and the second heating element 22 in the folded state are unfolded, by the biasing force from the biasing unit, and thus it is possible to unfold them with a small force.

In the above described printing apparatus 1 according to the embodiment, since the cover members 25 (dryer 20) can be folded, thereby contracting, if necessary, it is possible to expand or contract the area of the cover members 25 covering the conveyance path 8. Therefore, on the occasion of setting the medium 100 or when a jam has occurred, it is possible to contract the cover members 25 in the conveyance direction of the medium 100. Therefore, it is possible to suppress the cover members 25 from interrupting setting of the medium 100 or resolving of a jam. Also, since the cover members 25 are provided so as to be able to expand and contract in the conveyance direction of the medium 100, even in a case where the cover members 25 move once from the state where they cover the conveyance path 8, it is possible to easily return the cover members 25 to their original positions, and it is possible to easily return the cover members to the state where they cover a portion of the conveyance path S. As a result, it is possible to improve maintainability in the case of providing the cover members 25 for covering the conveyance path 8 of the medium 100.

Also, since a portion of the conveyance path 8 to which the medium 100 after inkjet printing is conveyed is covered by the cover members 25, it is possible to prevent something from coming into contact with the medium 100 where ink is wet, thereby preventing the medium from being contaminated, and provide the dryer 20 for drying ink. As a result, it is possible to improve maintainability while making it possible to appropriately perform inkjet printing.

Also, since the first cover part 26 and the second cover part 27 are connected so as to be relatively rotatable by the hinge 23, it is possible to easily obtain a structure in which the cover members 25 can expand and contract in the conveyance direction of the medium 100. As a result, it is possible to easily improve maintainability in the case of providing the cover members 25 for covering the conveyance path 8 of the medium 100.

Also, since the first cover part 26 and the second cover part 27 are connected so as to be foldable by the hinge 23, if the cover members 25 covering the conveyance path 8 are contracted in the conveyance direction of the medium 100, it is possible to save space after retreat of the cover members from the conveyance path 8. As a result, it is possible to more surely suppress the cover members 25 from interrupting maintenance, and it is possible to more surely improve maintainability in the case of providing the cover members 25.

Also, since both sides of the cover members 25 in the main scan direction are supported by the rotation connection parts 24 and the guide device 78, the cover members 25 can stably expand and contract in the conveyance direction of the medium 100. As a result, it is possible to more surely improve maintainability in the case of providing the cover members 25.

Also, since the hinge 23 and the guide device 78 prevent the cover members 25 from protruding into the printing apparatus 1, that is, toward the platen 7 during folding or unfolding, it is possible to prevent the cover members 25 from coming into contact with the conveyance path 8 or the medium 100, thereby damaging the medium 100 and the like. Also, since the motions of the cover members 25 during folding or unfolding are guided by the guide device 78, it is possible to smoothly perform work during folding or unfolding. As a result, it is possible to more surely improve maintainability in the case of providing the cover members 25.

Also, the positions of the cover members 25 in the vertical direction of the rotation connection parts 24 provided in the vicinity of the lower end of the second cover part 27 are fixed, and if the cover members 25 are contracted, they retreat downward from the conveyance path 8. Therefore, as compared to a case of withdrawing the cover members 25 upward, it is possible to increase the degree of opening of the conveyance path 8. As a result, it is possible to easily perform maintenance such as setting of the medium 100 or resolving of a jam, and it is possible to more surely improve maintainability.

Also, in a state where the cover members 25 are folded, the first cover part 26 and the second cover part 27 are fixed almost in a horizontal state. Therefore, it is possible to suppress the cover members 25 from excessively moving downward when the cover members 25 are withdrawn from the conveyance path 8. As a result, it is possible to suppress waste motion during expansion or contraction of the cover members 25.

[Modifications]

Also, in the printing apparatus 1 according to the above described embodiment, if air is blown from the air blowing fans 45 toward the gap between the cover members 25 and the medium 100, and enters the gap, the air is heated by the cord type heaters 28 with the cover members 25 interposed between. However, air may be heated before being sent into the gap between the cover members 25 and the medium 100. For example, cord type heaters 28 may be disposed inside the widening ducts 50. In this case, air heated in the widening ducts 50 may be sent out from the air outlets 61 and flow into the gap between the cover members 25 and the medium 100. In a case where air is directed substantially downward by the air-flow-direction changing wall parts 60 and then flows into the gap between the cover members 25 and the medium 100, the heating timing may be before or after the air enters the gap between the cover members and the medium.

Figure 12:
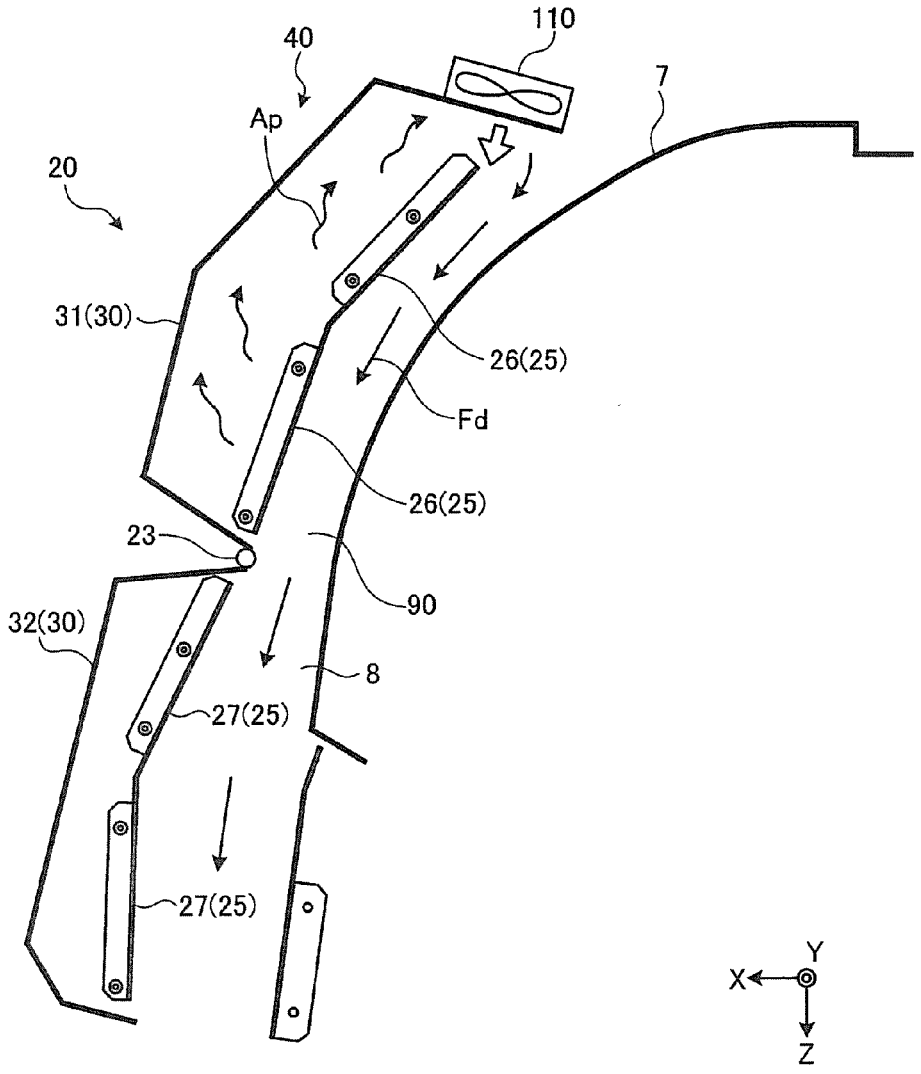
FIG. 12 is a view for explaining a case of using air blowing fans as flow path changer, as a modification of the printing apparatus according to the embodiment.

Also, in the printing apparatus 1 according to the above described embodiment, the air-flow-direction changing wall parts 60 are used as the flow path changer for changing the flow direction of the preliminary air Ap. However, as the flow path changer, devices other than the air-flow-direction changing wall parts 60 may be used. FIG. 12 is a view for explaining a case of using air blowing fans as flow path changer, as a modification of the printing apparatus according to the embodiment. For example, air blowing fans 110 which are air blowers may be provided on the upper side of the first cover part 26 as shown in FIG. 12, and be used as flow path changer. In this case, the air blowing fans 110 are provided not only as drying-air-flow supply for sending the drying air flow Fd into the gap between the medium 100 and the cover members 25 but also as flow path changer. Specifically, the air blowing fans 110 are disposed so as to be able to send air from the above of the air flow path 90 between the medium 100 and the cover members 25 into the air flow path 90. In this case, the air blowing fans 110 are disposed such that, if the preliminary air Ap positioned on the opposite side of the cover members 25 to the medium 100 is heated, the preliminary air ascends toward the air blowing faces of the air blowing fans 110.

In this case, if the preliminary air Ap positioned on the opposite side of the cover members 25 to the medium 100 is heated by the cord type heaters 28 provided on the cover members 25, the heated preliminary air Ap is sent into the gap between the medium 100 and the cover members 25 by the air blowing fans 110. In other words, the air blowing fans 110 change the flow direction of the heated preliminary air Ap, thereby sending the preliminary air Ap as the drying air flow Fd into the gap between the medium 100 and the cover members 25. If the drying air flow Fd enters the gap between the medium 100 and the cover members 25, the drying air flow in the gap is heated by the cord type heaters 28, whereby the temperature rises. Therefore, it is possible to easily send the drying air flow Fd toward the gap between the medium 100 and the cover members 25, and it is possible to easily dry ink on the medium 100 by the drying air flow Fd.

Figure 13:
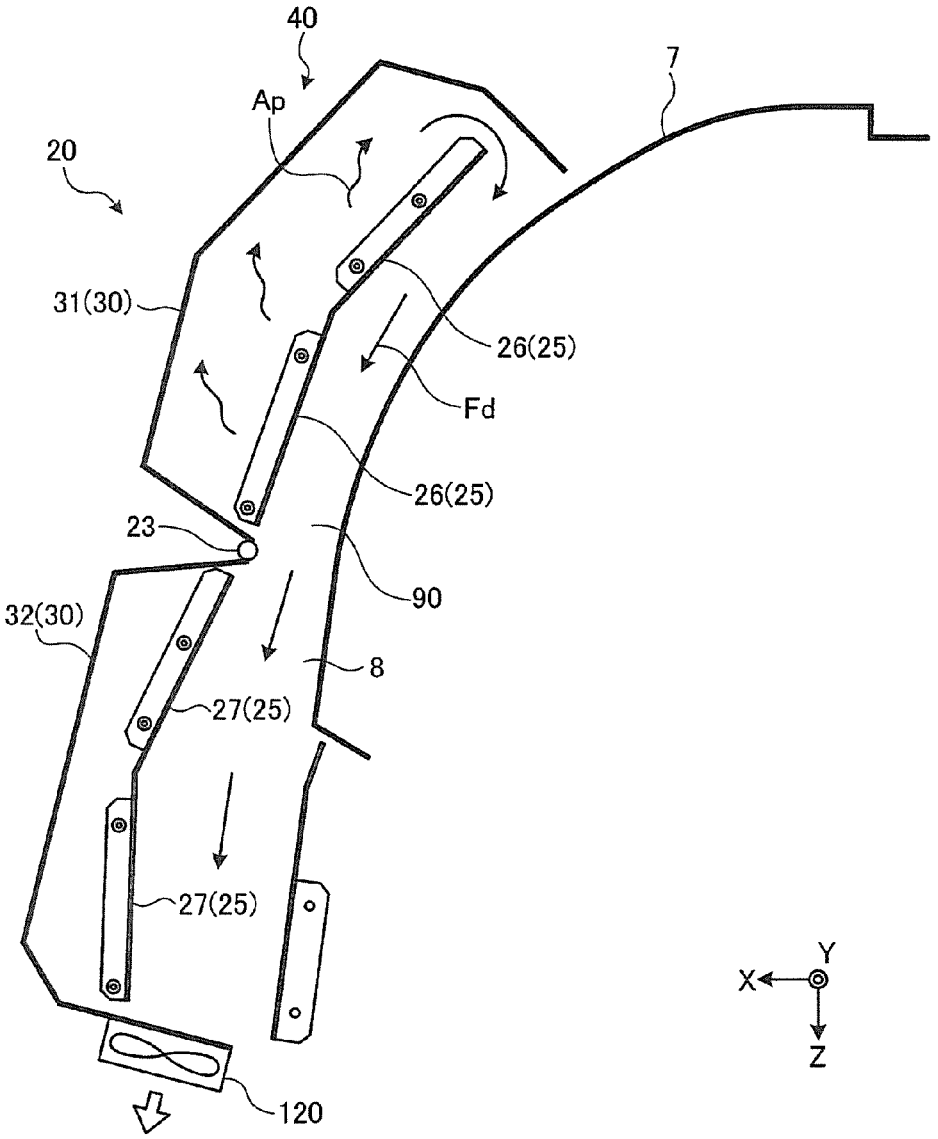
FIG. 13 is a view for explaining a case of using air intake fans as flow path changer, as another modification of the printing apparatus according to the embodiment.

Also, the flow path changer may suck air, thereby changing the flow direction of the preliminary air Ap. FIG. 13 is a view for explaining a case of using air intake fans as flow path changer, as another modification of the printing apparatus according to the embodiment. For example, air intake fans 120 which are air breathers may be provided below the second cover part 27 as shown in FIG. 13, and be used as flow path changer. In this case, the air intake fans 120 are provided not only as drying-air-flow supply for sending the drying air flow Fd into the gap between the medium 100 and the cover members 25 but also as flow path changer. Specifically, the air intake fans 120 are provided so as to be able to suck the drying air flow Fd in the air flow path 90 from below the air flow path 90 between the medium 100 and the cover members 25. In this case, it is preferable to the upper end portion of the first heating element cover 31 so as to cover even the upper side of the first cover part 26 such that the preliminary air Ap positioned on the opposite side of the first cover part 26 to the medium 100 flows into the gap between the medium 100 and the cover members 25, without flowing upward.

If the air intake fans 120 are provided as described above, the air intake fans 120 can suck the drying air flow Fd in the air flow path 90 between the medium 100 and the cover members 25, from below of the air flow path 90, and send the drying air flow downward. In a case where the drying air flow Fd in the air flow path 90 flows downward, since a negative pressure is produced inside the air flow path 90, the preliminary air Ap positioned on the opposite side of the first cover part 26 to the medium 100 flows from the upper end side of the first cover part 26 into the air flow path 90 between the medium 100 and the cover members 25. In other words, the air intake fans 120 suck the drying air flow Fd in the gap between the medium 100 and the cover members 25, thereby changing the flow direction of the preliminary air Ap positioned on the opposite side of the cover members 25 to the medium 100, such that the preliminary air flows as the drying air flow Fd into the gap between the medium 100 and the cover members 25. Since the preliminary air Ap is heated by the cord type heaters 28 disposed on the cover members 25, whereby its temperature rises, the temperature of the drying air flow Fd to flow into the gap between the medium 100 and the cover members 25 also rises. Also, the drying air flow Fd in the gap between the medium 100 and the cover members 25 is heated by the cord type heaters 28, whereby its temperature rises. Therefore, it is possible to easily send the drying air flow Fd toward the gap between the medium 100 and the cover members 25, and it is possible to easily dry ink on the medium 100 by the drying air flow Fd.

Also, in the printing apparatus 1 according to the embodiment described above, the cover members 25 of the dryer 20 are configured such that the first cover part 26 and the second cover part 27 can relatively rotate on the hinge 23, whereby the cover members can expand or contract. However, the cover members 25 may be configured so as to expand or contract in a manner other than relative rotation of the first cover part 26 and the second cover part 27.

Figure 14:
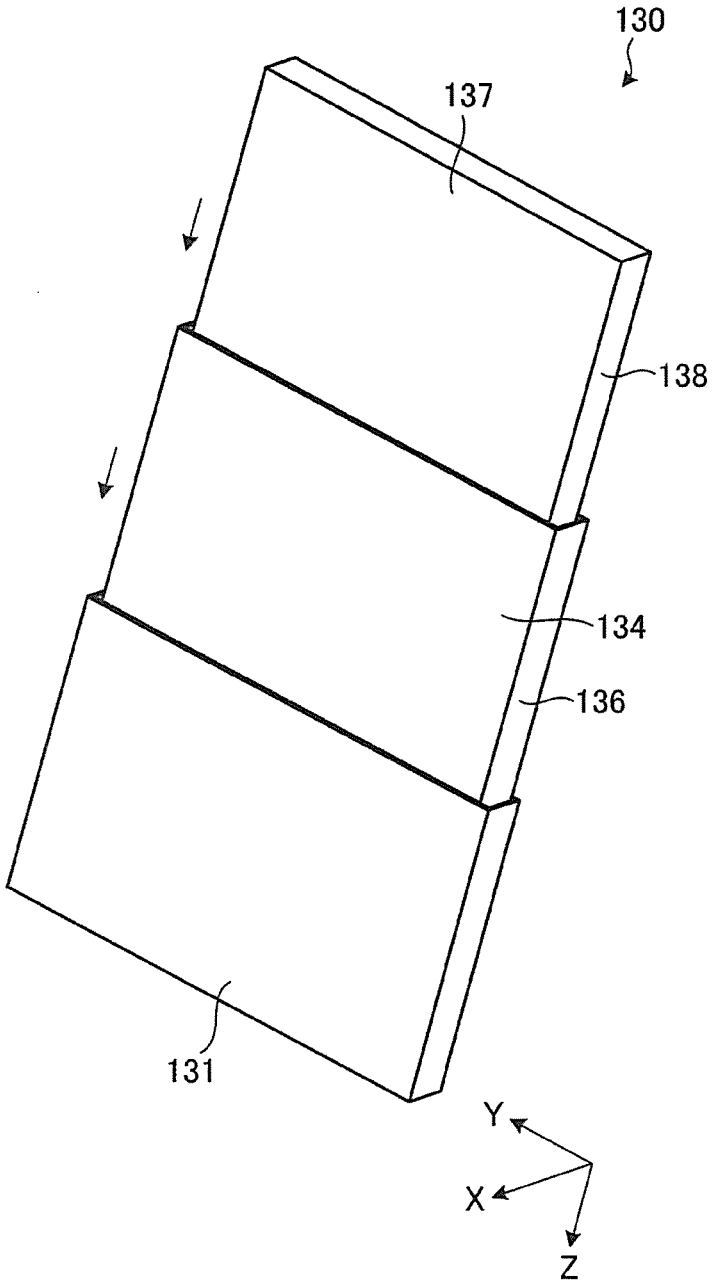
FIG. 14 is a perspective view of a cover member in a case where the cover member is configured to be slidable, according to another modification of the printing apparatus according to the embodiment.
Figure 15:
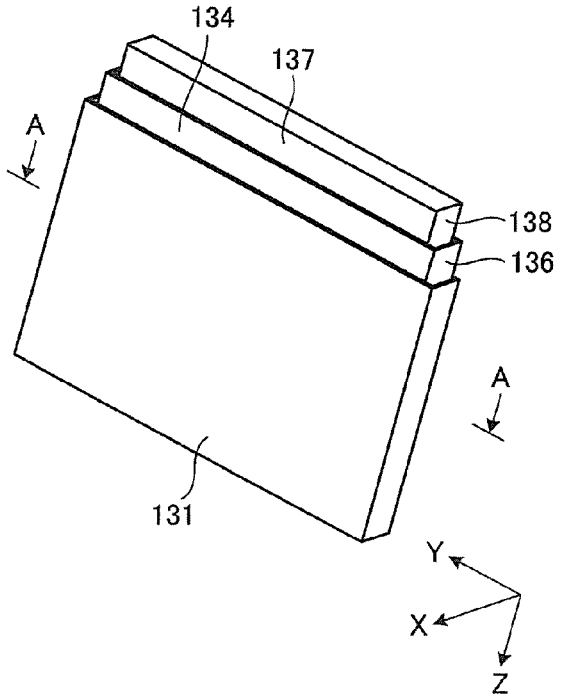
FIG. 15 is a perspective view illustrating a state where the cover member shown in FIG. 14 has contracted.
Figure 16:
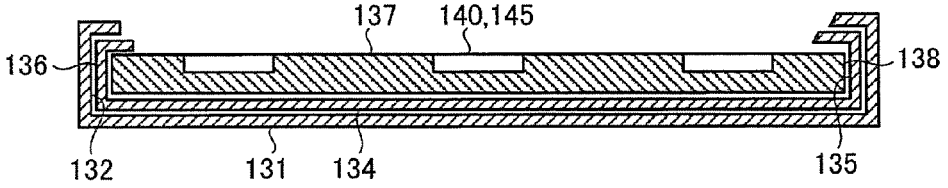
FIG. 16 is a cross-sectional view taken along a line A-A of FIG. 15.

FIG. 14 is a perspective view of a cover member in a case where the cover member is configured to be slidable, according to another modification of the printing apparatus according to the embodiment. FIG. 15 is a perspective view illustrating a state where the cover member shown in FIG. 14 has contracted. FIG. 16 is a cross-sectional view taken along a line A-A of FIG. 15. In order to configure a cover member 130 such that the cover member can expand and contract, a plurality of members constituting the cover member 130 may be configured to be relatively slidable. For example, as shown in FIGS. 14 to 16, the cover member 130 may be configured such that the cover member is divided into a first cover part 131, a second cover part 134, and a third cover member 137 which are a first segment, a second segment, and a third segment in the conveyance direction of the medium 100, and can expand or contract by relative sliding of the segments in the conveyance direction of the medium 100.

Specifically, in both ends of the first cover part 131 in the main scan direction, sliding grooves 132 are formed along the conveyance direction of the medium 100. The sliding grooves 132 are formed so as to be open toward the center of the first cover part 131 in the main scan direction.

Specifically, both end portions of the first cover part 131 in the main scan direction are folded back toward the center of the first cover part 131 in the main scan direction, and the insides of the folded portions become the sliding grooves 132.

Both end edges 136 of the second cover part 134 in the main scan direction are inserted into the sliding grooves 132 of the first cover part 131. In other words, the width of the second cover part 134 in the main scan direction is set to be slightly smaller than the intervals between the groove bottoms of the two sliding grooves 132 of the first cover part 131, and both end edges 136 of the second cover part 134 are inserted into the sliding grooves 132 of the first cover part 131. As a result, the second cover part 134 becomes slidable along the sliding grooves 132 of the first cover part 131.

Also, similarly to the first cover part 131, at both ends of the second cover part 134 in the main scan direction, sliding grooves 135 are formed along the conveyance direction of the medium 100 so as to be open toward the center of the second cover part 134 in the main scan direction. Both end edges 138 of the third cover member 137 in the main scan direction are inserted into the sliding grooves 135 of the second cover part 134. As a result, the third cover member 137 becomes slidable along the sliding grooves 135 of the second cover part 134. Also, on the third cover member 137, air blowers 140 for sending a drying air flow Fd into the gap between the medium 100 and the cover member 130, and a heater 145 such as heaters for heating the drying air flow Fd to heat an area positioned between the medium 100 and the cover member 130 are provided.

The cover member 130 is disposed such that the sliding grooves 132 of the first cover part 131 and the sliding grooves 135 of the second cover part 134 are aligned along the conveyance direction of the medium 100. Therefore, the first cover part 131 and the second cover part 134, and the second cover part 134 and the third cover member 137 can slide on each other in a direction along the conveyance direction of the medium 100.

Therefore, on the occasion of setting the medium 100 in the printing apparatus main body 2 and starting printing, the first cover part 131 and the second cover part 134, and the second cover part 134 and the third cover member 137 expand in the conveyance direction of the medium 100, whereby a portion of the conveyance path 8 is covered by the cover member 130. In this state, printing is performed. In this case, the air blowers 140 and the heater 145 heat the area between the medium 100 and the cover member 130, thereby drying ink on the medium 100. Also, in order to hold the cover member 130 in the expanded state, it is preferable that the members constituting the cover member 130 should have fixing device such as attraction of magnets or locking pins.

Also, in a case where printing of the printing apparatus 1 has finished, if necessary, the cover member 130 is contracted. In other words, the first cover part 131 and the second cover part 134, and the second cover part 134 and the third cover member 137 are contracted in the conveyance direction of the medium 100, such that the first cover part 131, the second cover part 134, and the third cover member 137 overlap one another, and the length of the cover member 130 in the conveyance direction of the medium 100 shortens. In this way, at least a portion of the first cover part 131, the second cover part 134, and the third cover member 137 of the cover member 130 retreats from the position for covering the conveyance path 8. As a result, in the printing apparatus 1, a portion of the platen 7 of the printing apparatus main body 2 positioned on a side of the dryer 20 is exposed, whereby it becomes easy to perform maintenance such as setting of the medium 100 in the printing apparatus main body 2.

In the cover member 130, as described above, the sliding grooves 132 are formed in the first cover part 131, and the sliding grooves 135 are formed in the second cover part 134. Therefore, it is possible to expand or contract the cover member 130 with a simple configuration, and it is possible to easily improve maintainability in the case of providing the cover member 130. Also, in a case of withdrawing the cover member from the position for covering the conveyance path 8, it is unnecessary to slide both of the second cover part 134 and the third cover member 137, and if necessary, only the third cover member 137 may be slid, such that the third cover member retreats from the position for covering the conveyance path 8. Also, in this modification, the cover member 130 is divided into the first cover part 131, the second cover part 134, and the third cover member 137. However, the cover member 130 may be divided in a different way. As long as the cover member 130 is divided into at least the first cover part 131 and the second cover, part 134 which are relatively slidable in the conveyance direction of the medium 100, the number of segments of the cover member 130 does not matter.

Figure 17:
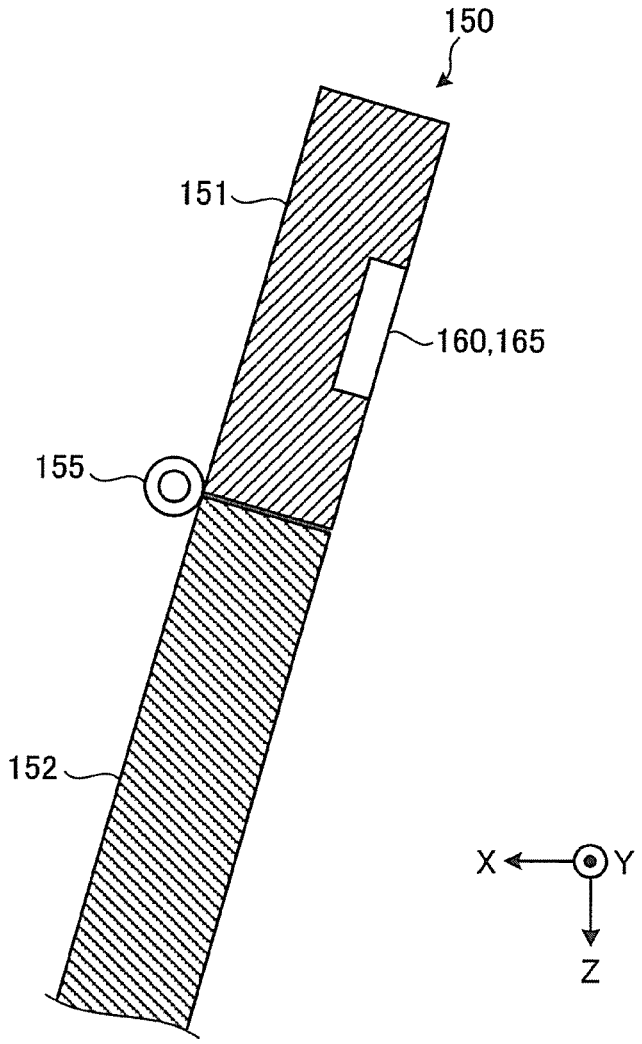
FIG. 17 is a cross-sectional view of a cover member in a case of providing only a hinge as a member for expanding and contracting the cover member, according to another modification of the printing apparatus according to the embodiment.

Also, in the printing apparatus 1 according to the above described embodiment, on the cover members 25, the hinge 23 and the rotation connection parts 24 are provided as members for expanding and contracting the cover members 25. However, it is unnecessary to provide all of the hinge and the rotation connection parts as members for expanding and contracting the cover members 25. FIG. 17 is a cross-sectional view of a cover member in a case of providing only a hinge as a member for expanding and contracting the cover member, according to another modification of the printing apparatus according to the embodiment. As a member for expanding or contracting a cover member 150, only a hinge 155 may be provided to connect the first cover part 151 and a second cover part 152 such that they can relatively rotate. For example, as shown in FIG. 17, the cover member 150 is divided into the first cover part 151 and the second cover part 152 in the vertical direction, that is, the conveyance direction of the medium 100, and on the first cover part 151 which is positioned on the upper side, air blowers 160 and heater 165 are provided. Also, the second cover part 152 is disposed so as to cover the conveyance path 8.

In the cover member 150, the lower end portion of the first cover part 151 and the upper end portion of the second cover part 152 are connected by the hinge 155, such that the first cover part 151 is rotatable with respect to the second cover part 152. In a case where the cover member 150 is configured as described above, on the occasion of performing printing in the printing apparatus 1, the first cover part 151 is rotated so as to cover the conveyance path 8. In this state, the air blowers 160 and the heater 165 heat an area between the medium 100 and the cover member 150, thereby drying ink on the medium 100.

Figure 18:
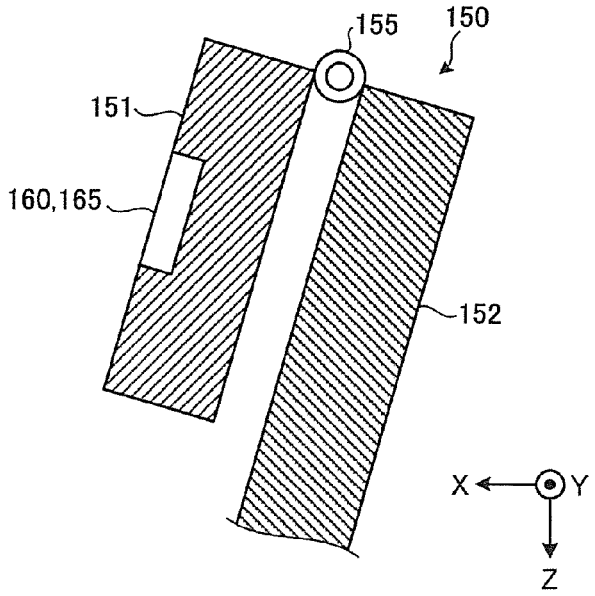
FIG. 18 is a cross-sectional view of the cover member shown in FIG. 17 in a state where the cover member is folded.

FIG. 18 is a cross-sectional view of the cover member shown in FIG. 17 in a state where the cover member is folded. In a case where printing of the printing apparatus 1 has finished, if necessary, the cover member 150 is folded. In other words, the first cover part 151 is relatively rotated on the rotating shaft of the hinge 155 with respect to the second cover part 152, such that the first cover part 151 moves away from the conveyance path 8 of the medium 100.

The first cover part 151 is rotated by about 180° so as to move away from the conveyance path 8 as described above, thereby being positioned on the opposite side of the second cover part 152 to the conveyance path 8. In other words, the first cover part 151 is relatively rotated with respect to the second cover part 152, whereby the first cover part is withdrawn from the position for covering the conveyance path 8 so as to overlap a surface of the second cover part 152 positioned on the opposite side to a surface on which the conveyance path 8 is positioned. As a result, in the printing apparatus 1, a portion of the platen 7 of the printing apparatus main body 2 positioned on a side of the dryer 20 is exposed, whereby it becomes easy to perform maintenance such as setting of the medium 100 in the printing apparatus main body 2.

Figure 19:
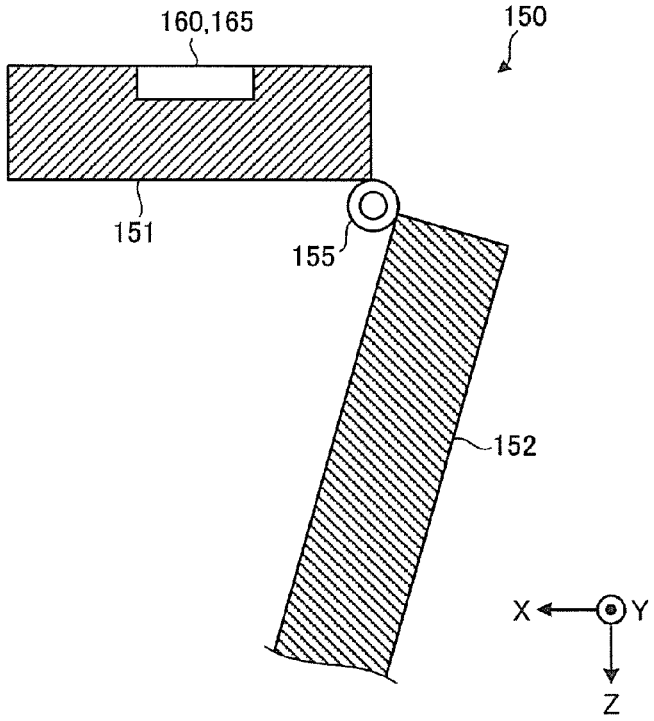
FIG. 19 is a cross-sectional view of the cover member shown in FIG. 17 in a state where the cover member is folded, and is an explanatory view illustrating another example of the folded state.

FIG. 19 is a cross-sectional view of the cover member shown in FIG. 17 in a state where the cover member is folded, and is an explanatory view illustrating another example of the folded state. However, in the case of providing only the hinge 155 as a member for expanding and contracting the cover member 150 such that the first cover part 151 and the second cover part 152 are connected so as to be relatively rotatable by the hinge, when the first cover part 151 is withdrawn from the position for covering the conveyance path 8, the first cover part 151 may not overlap the second cover part 152. For example, as shown in FIG. 19, in a case of withdrawing the first cover part 151 from the position for covering the conveyance path 8, the first cover part can be rotated such that a portion of the platen 7 of the printing apparatus main body 2 positioned on a side of the dryer 20 is exposed, whereby it becomes easy to perform maintenance such as setting of the medium 100. In order to stop the first cover part at an appropriate position, it is possible to provide a stopping mechanism to the hinge 155 or provide a separate stopper for stopping rotation. As long as the first cover part 151 can be withdrawn from the position for covering the conveyance path 8 such that it becomes easy to perform maintenance such as setting of the medium 100, forms after retreat from the position for covering the conveyance path 8 do not matter.

Also, the number of segments into which the cover member 150 is divided is not limited to two, and may be three or more. In this case, every two adjacent segments of the cover member 150 in the conveyance direction of the medium 100 are connected so as to be rotatable by a hinge 155, whereby it is possible to withdraw more segments from the position for covering the conveyance path 8. Also, since segments of the cover member 150 withdrawn from the position for covering the conveyance path 8 can be made compact, it is possible to improve maintainability. Also, the cover member can be configured such that an area to be expanded or contracted can be changed depending on situations. For example, in a case where the cover member is composed of three segments, the cover member can be configured such that it is possible to contract an area corresponding to one segment.

Also, in the printing apparatus 1 according to the above described embodiment, in the printing apparatus main body 2, the head 4 is provided so as to move along the Y bar 5, and during printing, the head 4 performs printing while reciprocating in the main scan direction. However, the head 4 may be provided so as to extend in the main scan direction. In other words, the head 4 may be provided so as to be able to eject ink over the entire print range in the main scan direction, and be configured such that, during printing, the head 4 can perform printing on the entire print range in the main scan direction at once without moving in the main scan direction. As long as the printing apparatus main body 2 is configured so as to be able to eject ink onto the medium 100 and be able to convey the medium 100 to the position of the dryer 20 after ink lands on the medium, the configuration of the head 4 does not matter.

Also, the above described printing apparatuses 1 according to the embodiment and modifications of the present disclosure are not limited to the embodiment and the modifications described above, and the components of the embodiment and the modifications can be appropriately combined.

What is claimed is:

1. A printing apparatus, comprising:

a cover member, covering at least a portion of a conveyance path for conveying a recording medium, wherein the cover member is configured such that at least a portion of a part covering the conveyance path is able to expand and contract, wherein the printing apparatus is an inkjet printing apparatus, and at least the portion of the conveyance path covered by the cover member is on which the recording medium conveyed after the recording medium is being inkjet printed, the cover member is retreatable and foldable from a position of covering the conveyance path, the cover member faces the recording medium when printing is performed, and the cover member comprises a dryer for drying an ink landed on the recording medium.

2. The printing apparatus according to claim 1, wherein the printing apparatus is an inkjet printing apparatus, and the conveyance path which is covered by the cover member is a portion to which the recording medium after inkjet printing is conveyed.

3. The printing apparatus according to claim 1, wherein the cover member is divided into at least a first segment and a second segment in a conveyance direction of the recording medium, between the first segment and the second segment, a rotator is provided to connect the first segment and the second segment such that the first segment and the second segment are relatively rotatable with respect to each other, and the first segment and the second segment are relatively rotatable by the rotator, whereby at least one of the first segment and the second segment is able to retreat from a position for covering the conveyance path.

4. The printing apparatus according to claim 2, wherein the cover member is divided into at least a first segment and a second segment in a conveyance direction of the recording medium, between the first segment and the second segment, a rotator is provided to connect the first segment and the second segment such that the first segment and the second segment are relatively rotatable with respect to each other, and the first segment and the second segment are relatively rotatable by the rotator, whereby at least one of the first segment and the second segment is able to retreat from a position for covering the conveyance path.

5. The printing apparatus according to claim 3, wherein the rotator is provided such that the first segment and the second segment is able to be folded.

6. The printing apparatus according to claim 3, wherein:

the rotator is provided such that a rotating shaft is disposed in a direction perpendicular to the conveyance direction of the recording medium, on one side of the cover member relative to the rotator in the conveyance direction of the recording medium, the rotating shaft is provided, and on the other side of the cover member, guide supporting parts are provided, the first segment and the second segment of the cover member are supported to be able to expand and contract by the rotating shaft and a guide device, the guide device includes the guide supporting parts and guide parts which are formed in slit shapes and into which the guide supporting parts are inserted, and the guide parts guide the guide supporting parts during expansion or contraction of the cover member.

7. The printing apparatus according to claim 4, wherein the rotator is provided such that a rotating shaft is disposed in a direction perpendicular to the conveyance direction of the recording medium, on one side of the cover member relative to the rotator in the conveyance direction of the recording medium, the rotating shaft is provided, and on the other side of the cover member, guide supporting parts are provided, the first segment and the second segment of the cover member are supported to be able to expand and contract by the rotating shaft and a guide device, the guide device includes the guide supporting parts and guide parts which are formed in slit shapes and into which the guide supporting parts are inserted, and the guide parts guide the guide supporting parts during expansion or contraction of the cover member.

8. The printing apparatus according to claim 5, wherein the rotator is provided such that a rotating shaft is disposed in a direction perpendicular to the conveyance direction of the recording medium, on one side of the cover member relative to the rotator in the conveyance direction of the recording medium, the rotating shaft is provided, and on the other side of the cover member, guide supporting parts are provided, the first segment and the second segment of the cover member are supported to be able to expand and contract by the rotating shaft and a guide device, the guide device includes the guide supporting parts and guide parts which are formed in slit shapes and into which the guide supporting parts are inserted, and the guide parts guide the guide supporting parts during expansion or contraction of the cover member.

9. The printing apparatus according to claim 3, wherein the rotator is a hinge, and the hinge causes the cover member not to protrude toward a side of the conveyance path during expansion or contraction of the cover member.

10. The printing apparatus according to claim 4, wherein the rotator is a hinge, and the hinge causes the cover member not to protrude toward a side of the conveyance path during expansion or contraction of the cover member.

11. The printing apparatus according to claim 5, wherein:

the rotator is a hinge, and the hinge causes the cover member not to protrude toward a side of the conveyance path during expansion or contraction of the cover member.

12. The printing apparatus according to claim 6, wherein:

the rotator is a hinge, and the hinge causes the cover member not to protrude toward a side of the conveyance path during expansion or contraction of the cover member.

13. The printing apparatus according to claim 7, wherein:

the rotator is a hinge, and the hinge causes the cover member not to protrude toward a side of the conveyance path during expansion or contraction of the cover member.

14. The printing apparatus according to claim 8, wherein:

the rotator is a hinge, and the hinge causes the cover member not to protrude toward a side of the conveyance path during expansion or contraction of the cover member.

15. The printing apparatus according to claim 1, wherein the cover member is divided into at least a first segment and a second segment in the conveyance direction of the recording medium, in the first segment, sliding grooves are formed along a conveyance direction of the recording medium, and both end edges of the second segment are configured to be inserted into the sliding grooves such that the second segment is slidable along the sliding grooves.

16. The printing apparatus according to claim 2, wherein the cover member is divided into at least a first segment and a second segment in the conveyance direction of the recording medium, in the first segment, sliding grooves are formed along a conveyance direction of the recording medium, and both end edges of the second segment are configured to be inserted into the sliding grooves such that the second segment is slidable along the sliding grooves.

* * * * *